US007322162B2

(12) United States Patent
Gifford

(10) Patent No.: US 7,322,162 B2
(45) Date of Patent: Jan. 29, 2008

(54) BAG TOP FOLDER AND LABELER

(75) Inventor: Jon W. Gifford, Brooklyn Park, MN (US)

(73) Assignee: Thiele Technologies, Inc., Minneapolis, MN (US)

( * ) Notice: Subject to any disclaimer, the term of this patent is extended or adjusted under 35 U.S.C. 154(b) by 85 days.

(21) Appl. No.: 11/407,579

(22) Filed: Apr. 20, 2006

(65) Prior Publication Data

US 2007/0245687 A1 Oct. 25, 2007

(51) Int. Cl.
*B65B 51/06* (2006.01)
*B65B 61/00* (2006.01)
*B65B 7/08* (2006.01)

(52) U.S. Cl. ..... 53/136.5; 53/372.7; 53/375.7

(58) Field of Classification Search ..... 53/136.1, 53/136.3, 136.5, 526, 372.6, 372.7, 375.7, 53/370.2, 370.6, 375.2, 375.5; *B65B 7/08*
See application file for complete search history.

(56) References Cited

U.S. PATENT DOCUMENTS 1,889,193 A * 11/1932 Craig ..... 53/375.7
1,973,696 A * 9/1934 Allison et al. ..... 53/136.5
2,023,682 A * 12/1935 Higginbottom ..... 53/136.5
2,094,927 A * 10/1937 Orstrom ..... 53/372.6
2,385,598 A * 9/1945 Allen ..... 53/375.7
2,925,695 A * 2/1960 Fry ..... 53/372.7
5,536,357 A * 7/1996 Kovacs ..... 53/136.5

* cited by examiner

*Primary Examiner*—Stephen F. Gerrity
(74) *Attorney, Agent, or Firm*—Clayton R. Johnson

(57) ABSTRACT

The bag top folder and labeler includes bottom and side conveyor assemblies for conveying a filled bag to extend between a pair of folder subassemblies wherein, with the bag top extending above the subassemblies, a second subassembly is operable to in cooperation with a first subassembly reversely fold the bag top relative to the second subassembly center folder and flap tuckers to form a generally Z-shaped bag top closure including ears extending outwardly in opposite directions and elevator mechanism for elevating the bag relative to the first subassembly to compensate for different densities of product in filled bags. Thereafter labeler mechanism applies labels to the folded bag top including to the ears, folds the ears downwardly along the end walls and wipes the labels to adhere to the ears and the bag front and rear end walls below the ears.

20 Claims, 15 Drawing Sheets

BAG TOP FOLDER AND LABELER

BACKGROUND OF THE INVENTION

This invention relates to apparatus for folding the tops of filled bags and applying labels thereto.

In prior art with bag top closures that have a single fold, at times insects move between the folded portion of bag top and the adjacent part of the bag and manage to get into the interior of the bag. In order to provide an improved bag top closure with labels, this invention has been made.

SUMMARY OF THE INVENTION

The apparatus includes a bottom conveyor assembly that is vertically moveable and a side conveyor assembly that is horizontally movable for conveying a filled bag with bag top portions of its end and side walls extending above the product in abutting relationship in a forward direction to a folding station to extend between a pair of bag top folder subassemblies. The folder subassemblies are operated to move the bag top to provide a generally Z-shaped fold. Then the bag is elevated relative to at least one of the folder subassemblies in abutting relationship therewith to compensate for varying densities of the product in the filled bag and thence the labeler mechanism moves down to fold the ears of the folded bag top downwardly and apply pressure sensitive labels to the generally horizontal top part of the fold, the ears and the part of the bag below the ears to retain the bag top in the folded relationship to remainder of the bag. After the folder subassemblies have returned to the positions they had prior to there folding operation, the labeler impresser pads have been retracted and the bag lowered relative to the bottom conveyor assembly, the side and bottom conveyor assemblies are operated to move the bag forwardly of the folding station.

One of the objects of this invention is to provide a new and novel bag top closure. Another object of this invention is to provide new and novel means for folding the bag top portions of a filled bag. In furtherance of the last mentioned object, it is another object to provide new and novel means for providing a new and novel type folding of the top portion of the filled bag and applying a pressure sensitive label to the folded bag top closure to retain the folded bag top in its folded position.

DETAILED DESCRIPTION OF THE INVENTION

Figure 21:
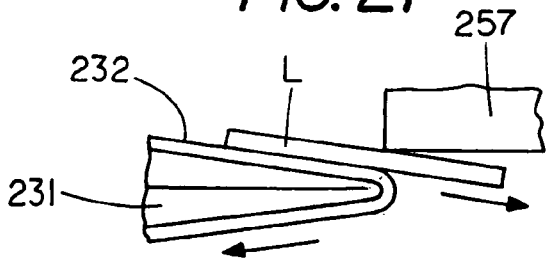
Figure 22:
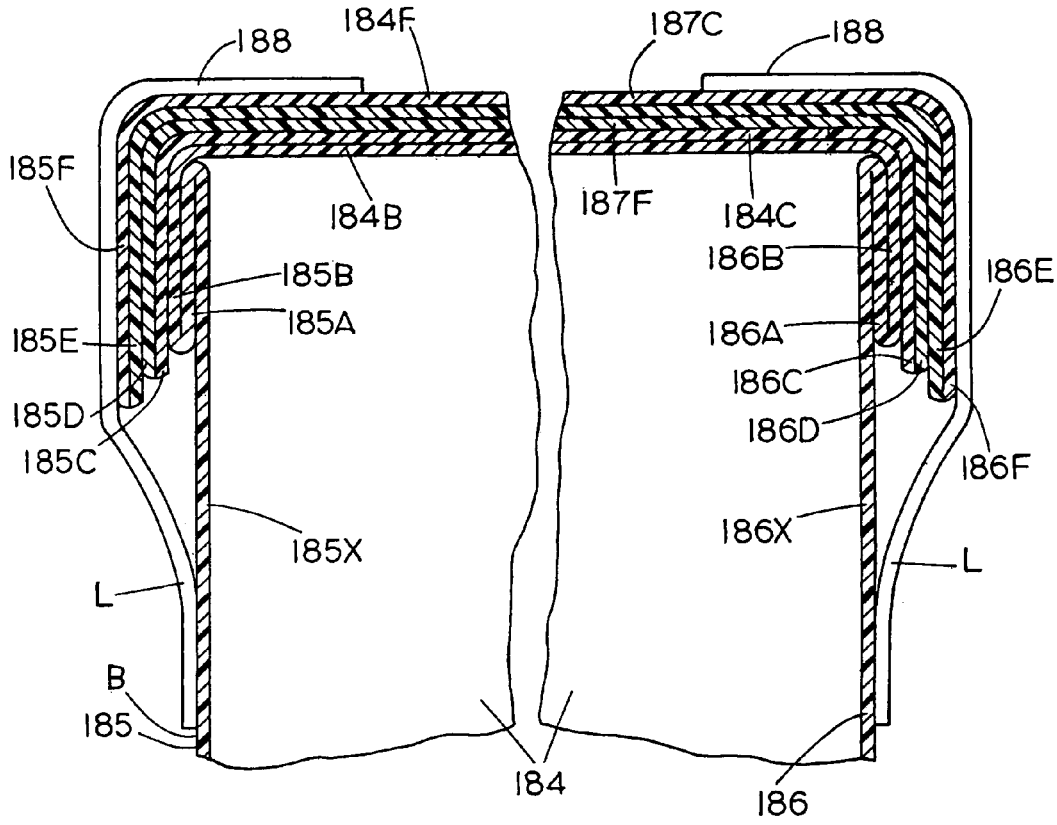
Figure 23:
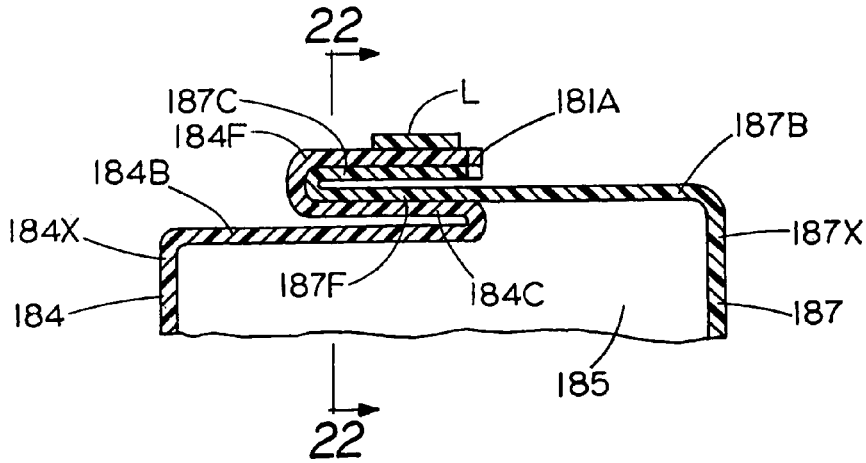
Figure 24:
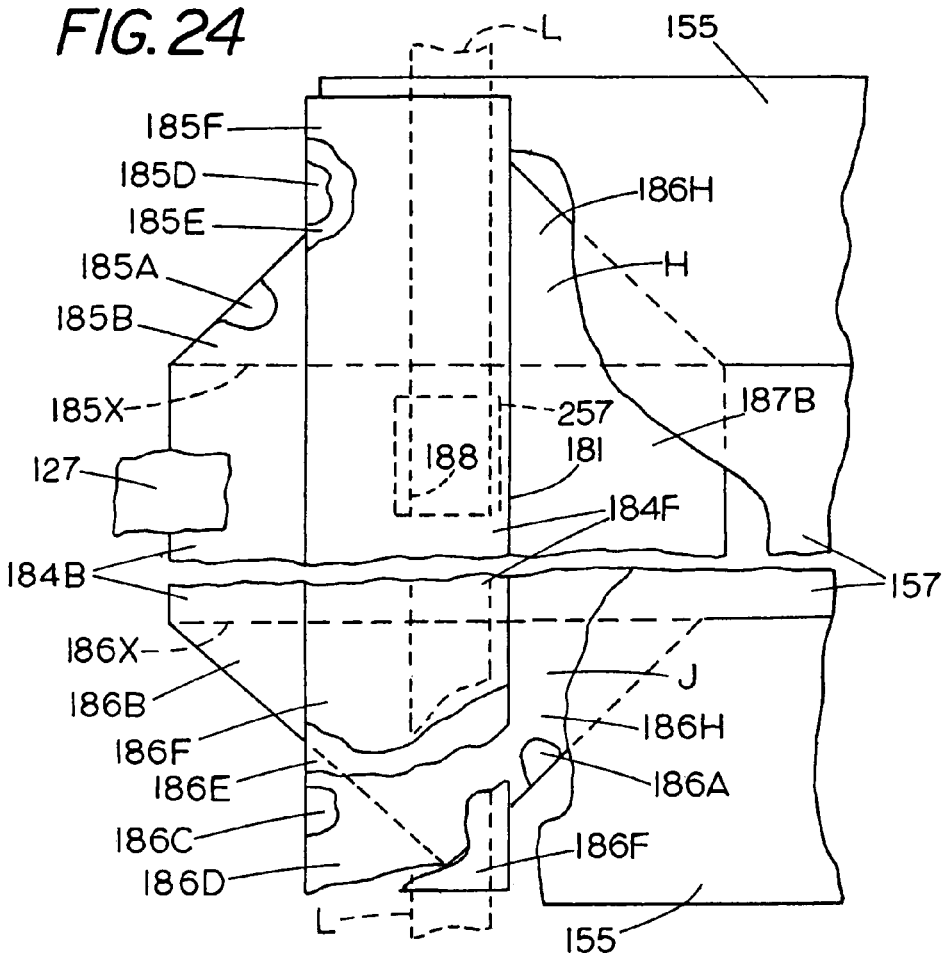
Figure 25:
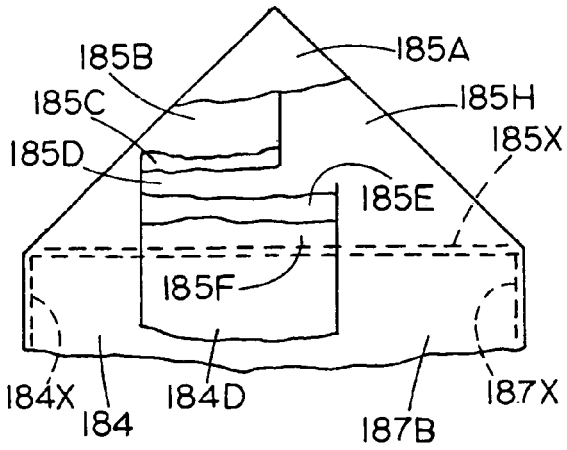
Figure 26:
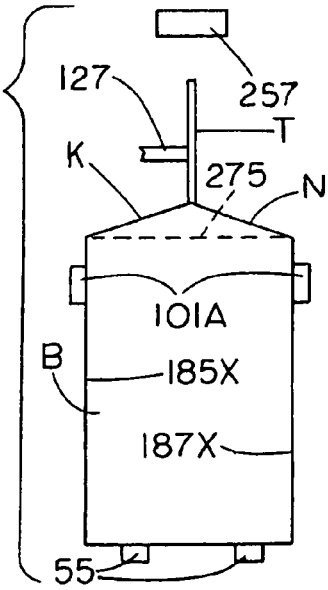

FIG. 21 a simplified fragmentary transverse diagrammatic view to indicate a label being peeled from the web and moving under the impresser pads;

FIG. 22 is a fragmentary cross sectional view of the top portion of a filled bag that has the bag top folded by the apparatus of this invention, said view being generally taken along the line and in the direction of the arrows 22-22 of FIG. 23;

FIG. 23 is a fragmentary transverse cross sectional view of the bag of FIG. 22;

FIG. 24 is a fragmentary plan view with longitudinal intermediate portion and other portions broken away that shows a part of the bag top prior to the retraction of the tuckers and the ears being folded down along the end walls of the filled bag and in dotted lines indicating the locations one of the impresser pads and the labels relative to the folded bag top closure prior to the ears being folded down;

FIG. 25 is view of the part of the folded bag top closure shown in FIG. 22 other than various parts are broken away to show parts of the closure that are therebeneath; and FIG. 26 is a somewhat diagrammatic end view to show a filled bag being conveyed to a position that the bag top is folded.

DETAILED DESCRIPTION OF THE INVENTION

Figure 1:
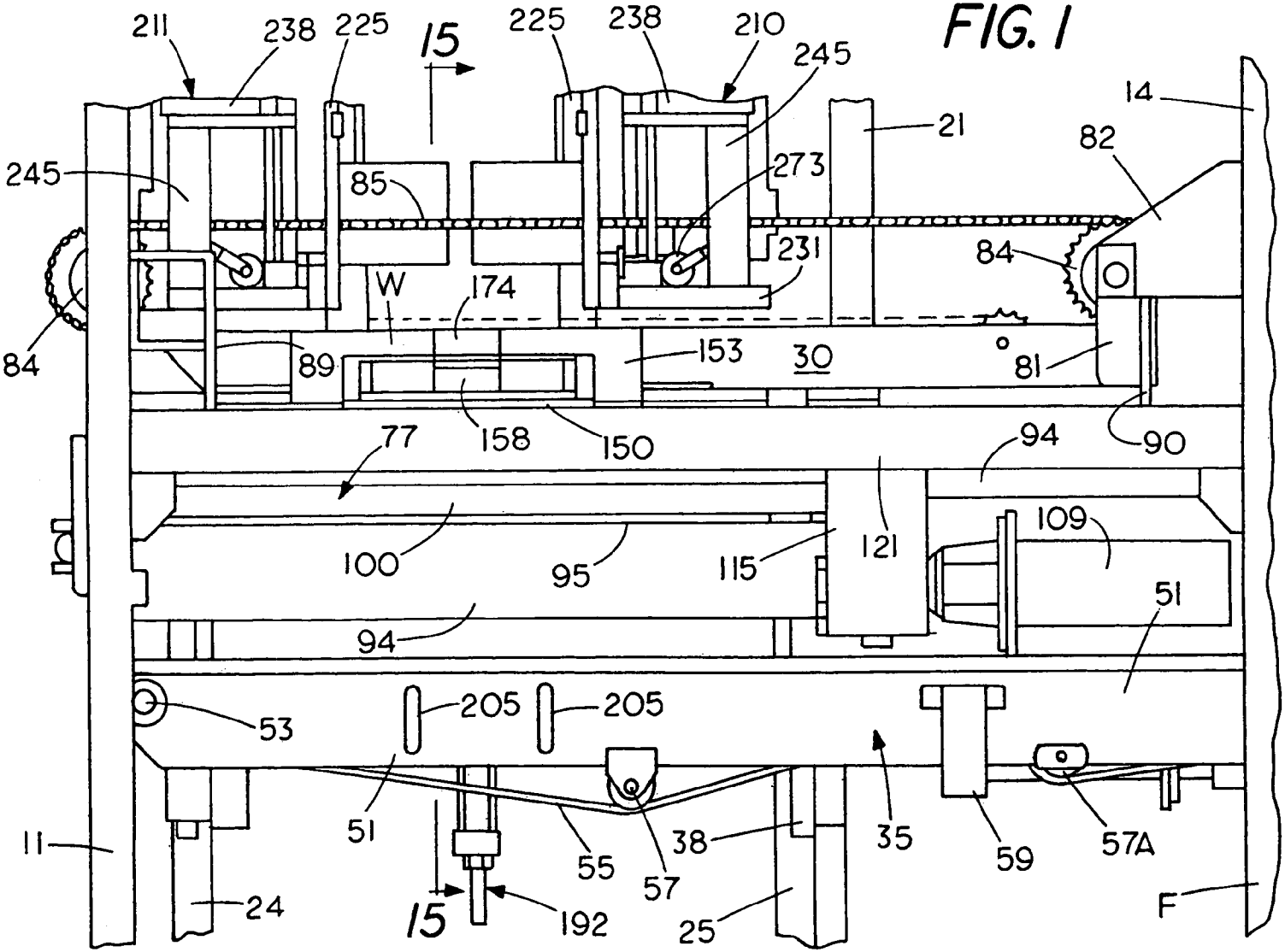
FIG. 1 is a fragmentary side view of the bag top folder labeler apparatus of this invention with various structural features not being shown.
Figure 2:
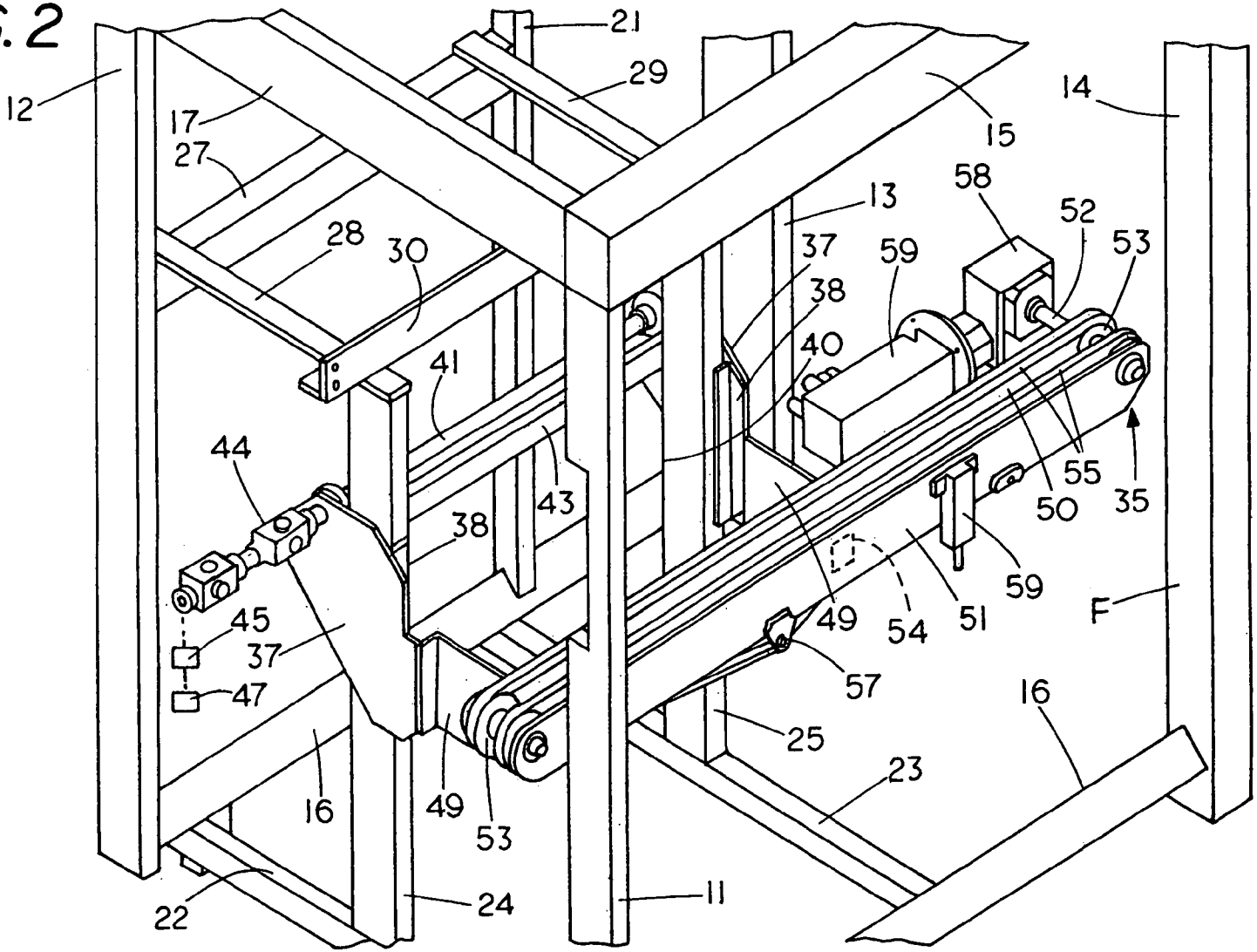
FIG. 2 is a fragmentary perspective view showing the bottom conveyor assembly with the elevator subassembly not being shown.
Figure 3:
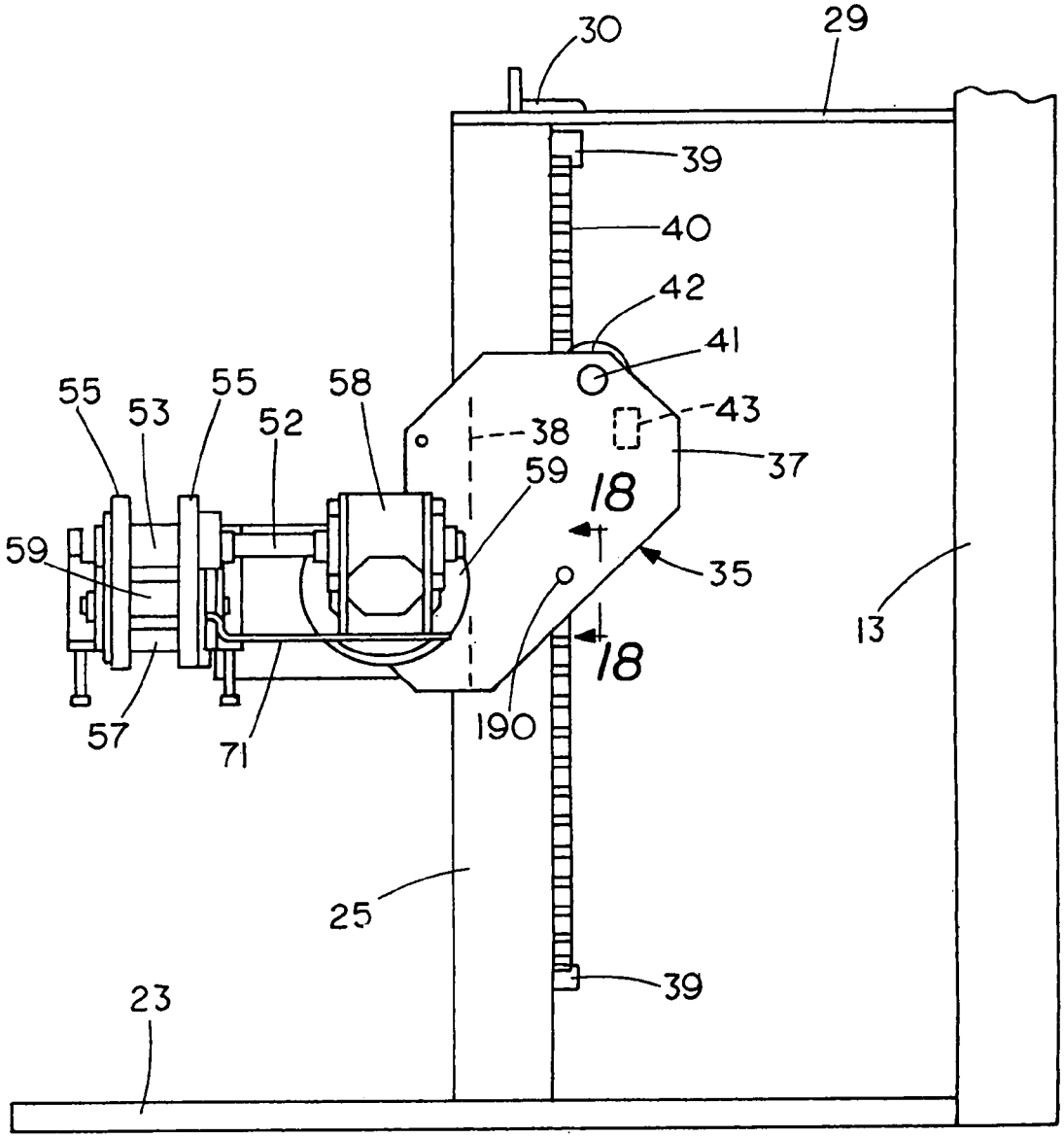
FIG. 3 is a front end view of the bottom conveyor assembly.
Figure 4:
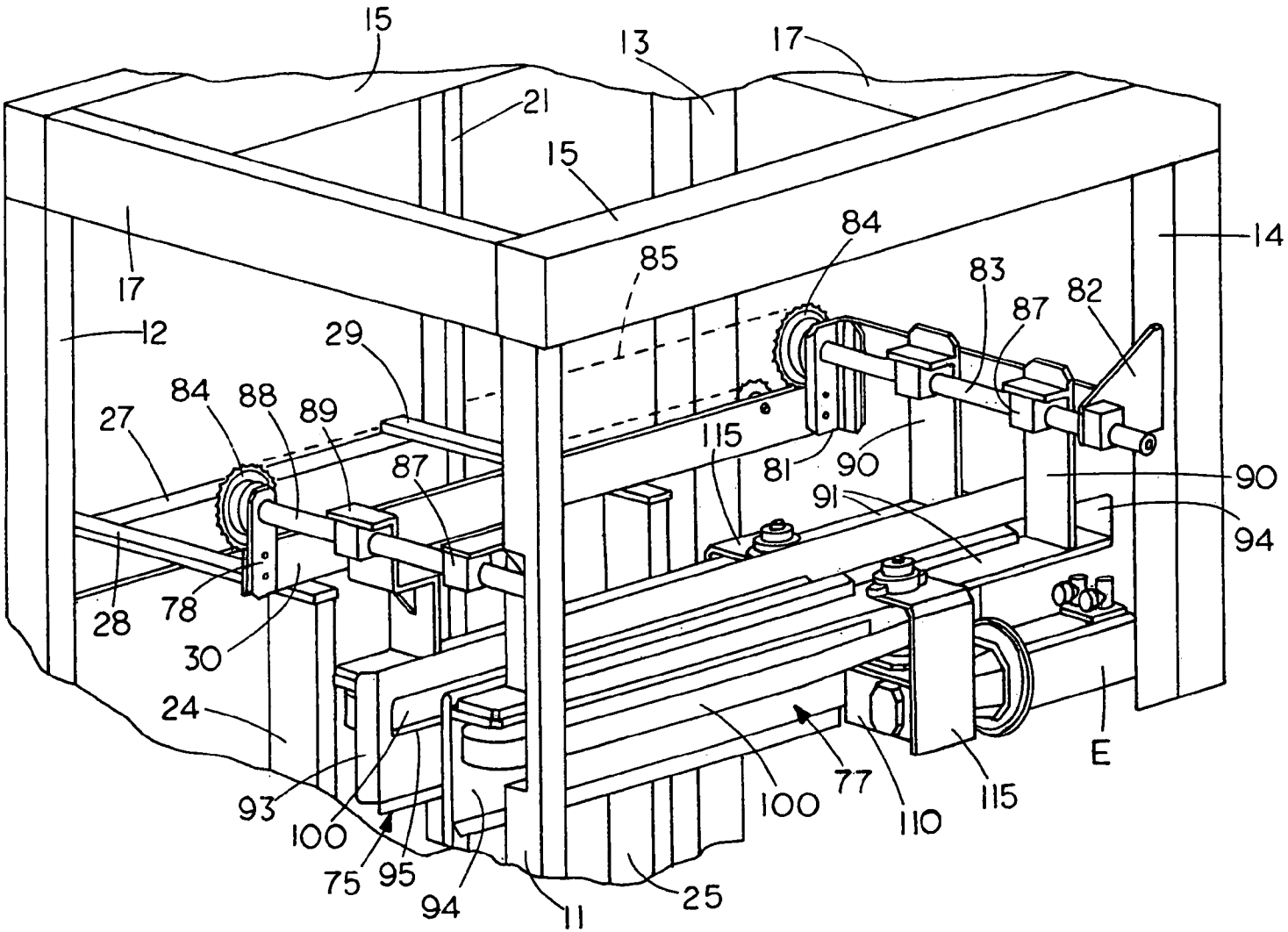
FIG. 4 is a fragmentary perspective view showing the side conveyor assembly.

Referring in particularly to FIGS. 1, 2 and 4 of the drawings, the apparatus of this invention includes a frame F having vertical rear frame members 11, 12, vertical front frame members 13, 14, bottom longitudinally frame members 16 extending between the front and rear vertical frame members, top longitudinal frame members 15 extending between and joined to the top and rear vertical frame members, top front and rear transverse frame members 17 respectively joined to frame members 13, 14 and 11, 12, rear transverse and intermediate transverse frame members 22, 23 mounted to frame members 16, a longitudinally intermediate, vertical frame member 21 joined to frame members 15, 16, a vertically intermediate, longitudinal frame member 27 joined to frame members 12, 21, transversely intermediate, vertical frame member 24, 25 joined to frame members 22, 23 respectively and horizontal transverse frame members 28, 29 joined to frame member 27 and the top of frames members 24, 25 respectively and a longitudinal frame member 30 joined to frame members 28, 29 above frame members 24, 25.

Referring to FIGS. 1-3 and 15, the bottom conveyor assembly, generally designated 35, includes longitudinally spaced mounting plates 37 extending transversely on longitudinally opposite surfaces of frame members 24, 25 with brackets 38 mounted thereto to vertically slidably abut against longitudinal surfaces of frame members 24, 25. The transversely opposite side portions of the frame members 24, 25 have vertically spaced chain mounts 39 mounted thereto for mounting vertically elongated chains 40 in abutting relationship to the frame members 24, 25.

Figure 18:
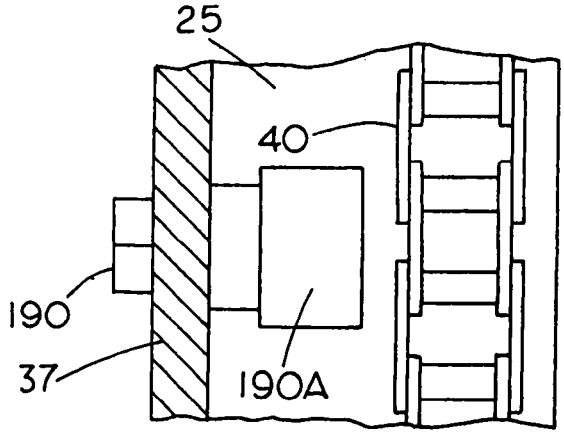
FIG. 18 is a fragmentary side view, part in cross section, that is generally taken along the line and in the direction of the arrows 18-18 of FIG. 3.

The mounting plates 37 rotatably mount a horizontal shaft 41 that have sprockets 42 keyed thereto to engage the chains for vertically moving the mounting plates as the shaft is rotated. Also referring to FIG. 18, mounted to each of the mounting plates at a substantially lower elevation than the shaft 41 is a cam follower 190 to have its roller 190A bear against the surface of the respective frame member 24, 25 adjacent the respective chain 40 to prevent binding of the brackets as the elevation of bottom conveyor assembly is varied. One end of the shaft 41 is connected through coupling mechanism 44 to a motor 45 for rotating the shaft in the desired angular direction in response to suitable controls 47. A beam 43 is mounted to the mounting plates on the same side of the frame members 24, 25 as the shaft.

On longitudinally opposite sides of the frame members 24, 25 the mounting plates mount brackets 49 which in turn mount a longitudinally elongated conveyor side plate 50 while a second side plate 51 is mounted in parallel relationship thereto, in part by spacers 54 (only one being shown). Longitudinally opposite ends of the side plates mount timing pulleys 53 while the front pulleys are drivenly connected through a shaft 52 to a gear box 58 and therethrough to a motor 59 which is mounted by brackets 71 to the adjacent side plate. A pair of endless timing belts 55 are mounted by pulleys 53 and in engagement with idler pulleys 57, 57A and adjustment pulley mechanism 59 (details not shown).

Figure 6:
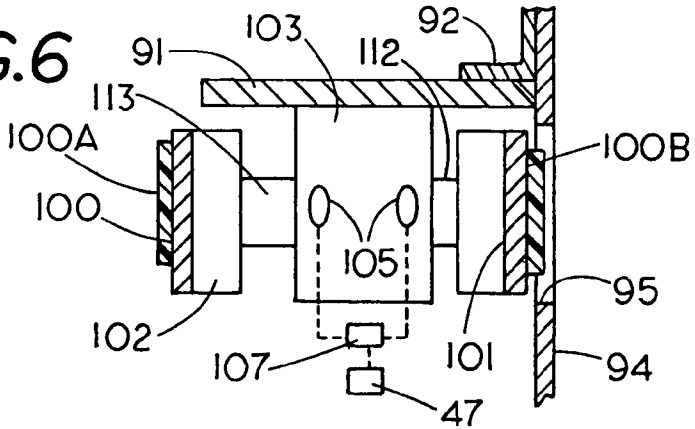
FIG. 6 is a fragmentary cross section view of one of the side conveyor subassemblies that is generally taken along the line and in the direction of the arrows 6-6 of FIG. 5.
Figure 5:
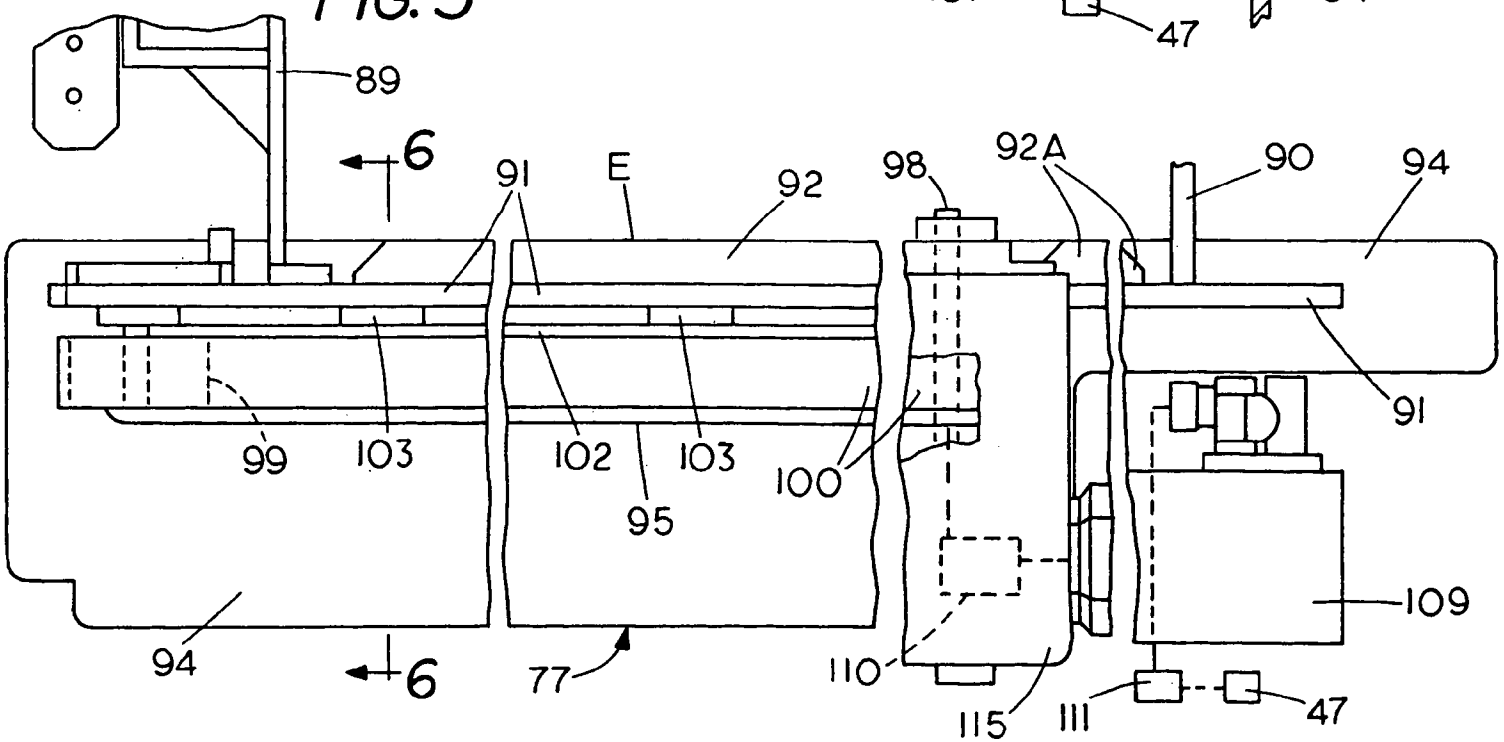
FIG. 5 is a fragmentary view, part schematically, showing a side conveyor subassembly with longitudinal intermediate portions broken away.

Referring to FIGS. 4-6, the side conveyor assembly E includes side conveyor subassemblies, generally designated 75, 77, that at one longitudinal ends are dependingly mounted from adjustment nuts 87 by brackets 89. The nuts are mounted by a transverse rear shaft 88 having oppositely threaded portions (threads not shown) whereby when the shaft is rotated in one angular direction, the nuts are transversely moved apart and when rotated in the opposite direction, move transversely toward one another. The rear shaft 88 at one end is mounted by a bracket (not shown) to frame member 11 and at the opposite end by a bar 78 to frame member 30 whereby the side conveyor subassemblies are at a higher elevation than the bottom conveyor assembly to have a filled bag B conveyed therebetween. A bracket 82 which is mounted to frame member 14 and a bar 81 which is mounted to frame member 30 mount a transverse front shaft 83. The front shaft also mounts adjustment nuts 87 to be transversely moved as indicated relative to the rear shaft, brackets 90 dependingly mounting the subassemblies from the front adjustment nuts 87. The one ends of shafts 83, 88 mount sprockets 84 which in turn mount a chain 85 whereby as a crank (not shown) mounted to the opposite end of the front shaft causes the shafts to rotated for appropriately transversely moving the adjustment nuts and thereby the brackets mounted thereto in the desired transverse direction to change the transverse spacing of the side conveyor subassemblies.

Each of the subassemblies 75, 77 includes a longitudinally elongated, horizontal mounting plate 91 mounted by the respective set of brackets 89, 90. Mounted by angle irons 92, 92A to transversely adjacent edge portions of the mounting plates 91 are longitudinally elongate side guides (side plates) 93, 94 respectively to extend above and below the mounting plates for having a bag on the bottom conveyor assembly longitudinally moved therebetween. Each of the side guides has a longitudinally elongated slot 95.

Mounted to the rear portion of each of the mounting plate 91 to rotate about vertical axes is a rear pulley 99 and a longitudinally intermediate driven pulley 98, each set of pulleys mounting an endless belt 100 at the elevation of the slots 95. Dependingly mounted to each of the mounting plates are a pair of longitudinally spaced cylinders 103 to be transversely intermediate the inner run 100B and the outer run 100A of the respective belt 100 and longitudinally intermediate the pulleys 98, 99, the runs of the belts transversely adjacent one another being considered the inner runs. Each cylinder has piston rods 112, 113 extending transversely outwardly of opposite ends of the cylinder for respectively mounting longitudinal elongated belt guides 101, 102 to abut against the adjacent, longitudinal elongated portions of the belt runs 100B, 100A respectively. Fluid under pressure is applied to the cylinders 103 through ports 105 to selectively move the piston rods 112 in a direction whereby an elongated portion of each inner run 100B is transversely moved toward the other and the piston rods 113 toward each other, and alternately in the opposite transverse direction. The direction of movement of the piston rods is controlled through conventional valving mechanism 107 which is in turn controlled by controls 47. The movement of the inner runs toward one another move through the slots 95 in the side guides is to apply pressure to the side walls of a filled bag being conveyed between the side guides and alternately away from one another to discontinue the application of pressure on the bag.

To each mounting plates 93, 94 there is mounted a bracket 115 which in turn mounts gear mechanism 110 and a motor 109 that is powered by fluid from a conventional controlled source 111 which is controlled by controls 47 for selectively operating the motor. Each motor 109 is drivingly connected through the gear mechanism 110 to drivingly rotate the respective pulley 98.

Referring in particular to FIGS. 7-9 and 15, the bag top folder assembly W which is at the bag folding station includes folder subassemblies, generally designated 117 and 118 respectively, subassembly 117 being mounted to a longitudinal frame member 30 longitudinally intermediate frame members 24, 25 to extend transversely toward and transversely spaced from subassembly 118 which is mounted to a longitudinal frame member 121. Frame member 30 is mounted to frame members 28, 29 to extend about the longitudinal length thereof while frame member 121 is mounted to frame members 11, 14.

Subassembly 117 includes a wiper mount 122 which is mounted to frame member 30 and mounts longitudinally spaced gusset folders 123 to extend thereabove in abutting relationship to frame member 30. A guide plate 124 is mounted to the wiper mount for transverse slidably movement beneath the guide plate by slide guides 125. Further, a wiper (wiper plate) 127 is mounted above the wiper mount for transverse movement, the wiper including fingers 127A extending longitudinally outwardly of the wiper main body 127B and has a longitudinal central terminal edge portion 127C more closely adjacent to subassembly 118 than the corresponding longitudinal terminal edges 126 of the fingers and the adjacent longitudinal terminal edge of the guide plate.

The wiper 127 is mounted to the guide plate 124 to move therewith by mounting pins 131 extended through spacers 129 which extend through a transversely elongated slot 134 in the wiper mount. The spacers 129 together with wear strips (not shown) retain the wiper spaced from the wiper mount. A cylinder 139 is mounted beneath the guide plate 124 and to the wiper mount 122 by mounting pins 138 extended through spacers 137 which extend through a transversely elongated slot 140 in the guide plate 124. The spacers together with wear strips (not shown) retain the cylinder 139 spaced from the guide plate 124 and the guide plate spaced from the wiper mount. The cylinder 139 is part of a piston cylinder combination that includes piston rods 141 (only one shown) attached to a bar 142 which is mounted to the guide plate 124 transversely remote from subassembly 118. When the piston rods 141 are in their extended positions, the guide plate 124 and the wiper 127 are in their furthermost transverse position from subassembly 118 and when retracted, the guide plate and wiper are moved more closely adjacent to the subassembly 118 to extend close to the path of movement of the bag top of a filled bag without interfering with the movement thereof by the conveyor assemblies.

Referring to FIGS. 7 and 11-15, the subassembly 118 includes a wiper mount 150 mounted to the frame member 121 to extend transversely toward the subassembly 117 with folder gussets 151 mounted to the frame member 121 and dependingly mounted to the wiper mount. A cylinder 158 of a piston cylinder combination that includes piston rods 159 is mounted to the wiper mount by pins 138 extended through spacers 161 which extend through the transversely elongated slot 156 in the center folder (folder plate) 157. The piston rods are transversely extended through a generally rectangular slot 154 in the link plate 153 and attached to a block 170 which is mounted to the longitudinal edge portion of the center folder 157 that is remote from the subassembly 117.

Figure 11:
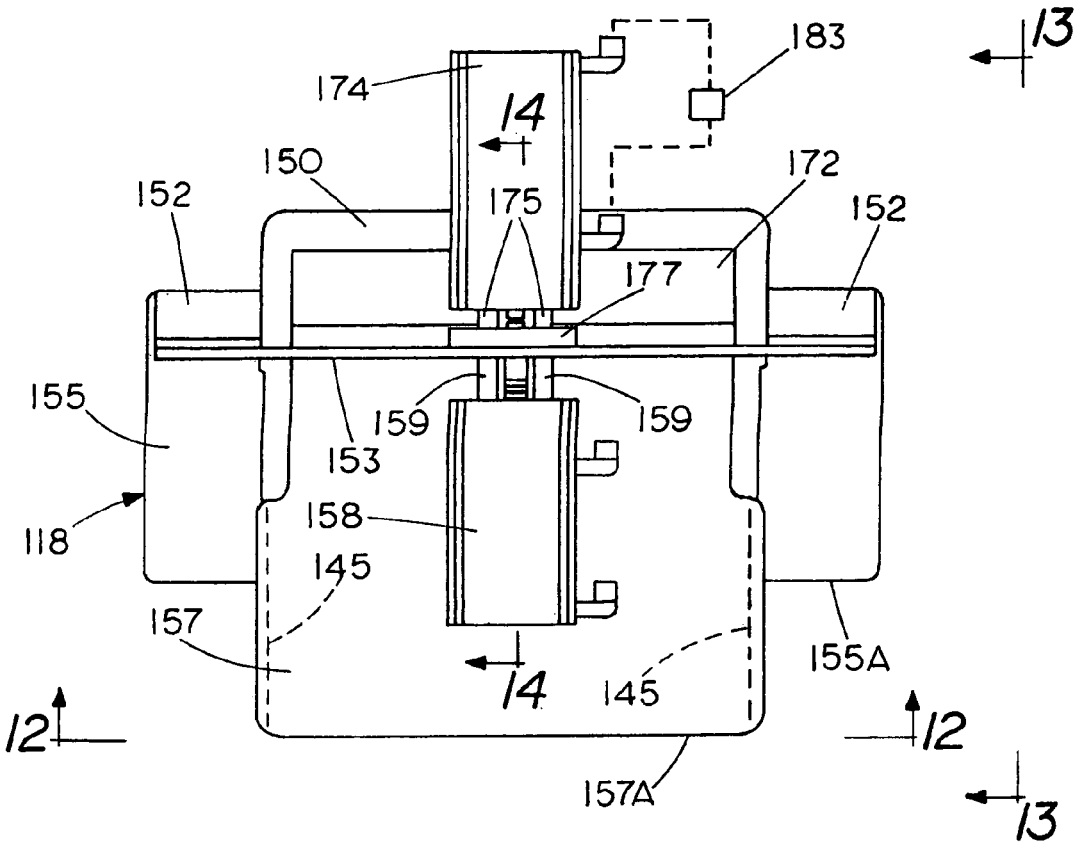
FIG. 11 is a plan view of a second folder subassembly that is generally taken along the line and in the direction of the arrows 11-11 of FIG. 7.
Figure 12:
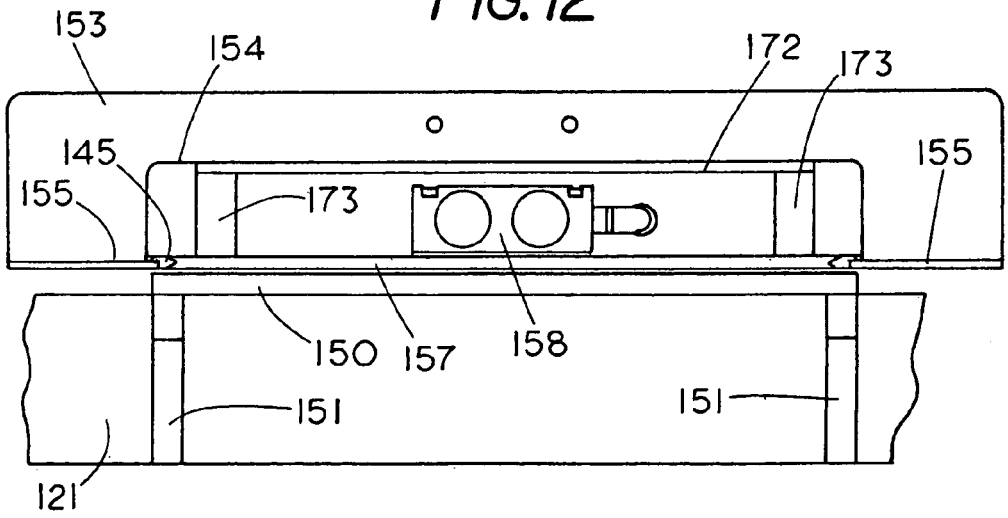
FIG. 12 is a side view of the subassembly of FIG. 11 that is generally taken along the line and in the direction of the arrows 12-12 of FIG. 11.
Figure 13:
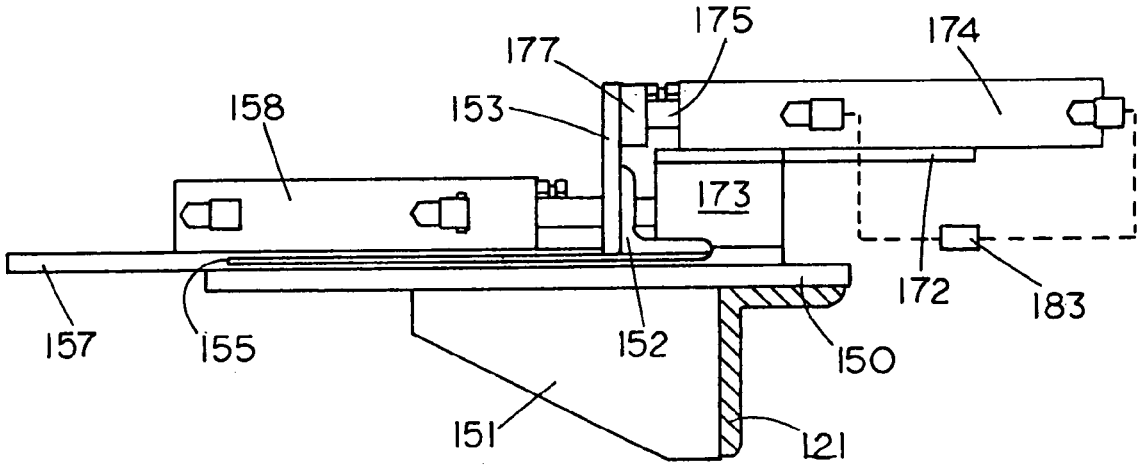
FIG. 13 is an end view of the subassembly of FIG. 11 that is generally taken along the line and in the direction of the arrow 13-13 of FIG. 11.

A cylinder 174 of a piston cylinder combination that includes piston rods 175 is mounted to an actuator mount 172, which may be T-shaped, by mounting pins 178 with the actuator mount in turn being mounted to longitudinally spaced blocks 173. The blocks 173 are mounted to wiper mount with the block 170 being longitudinally therebetween. The transversely extending piston rods 175 mount a bar 177 which in turn mounts the longitudinally center part of the link plate 153 with the link plate being transversely between the cylinders 158, 174 when the piston rods 175 are in their retracted position and the piston rods 159 are in their extended position. The longitudinally opposite end portions of the link plate mount tucker angles 152 which in turn mount lower flap tuckers 155 to extend toward the subassembly 117. The flap tuckers have longitudinally adjacent, transverse edges extended in transverse grooves 145 in the center folder. The flap tuckers have longitudinal terminal edges 155A and the center folder has a longitudinal terminal edge 157A that are more closely adjacent to the subassembly 117 than the rest of the flap tuckers and the center folder when the guide plate is in its retracted position as shown in FIGS. 7 and 11.

Figure 14:
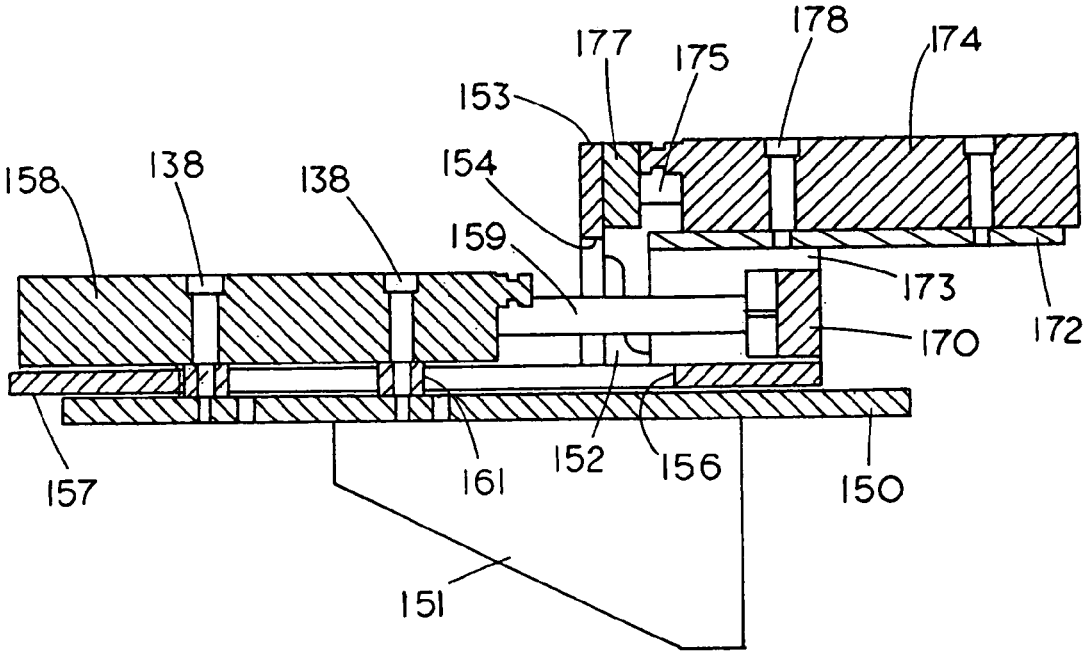
FIG. 14 is an enlarged fragmentary cross sectional view that is generally taken along the line and in the direction of the arrows 14-14 of FIG. 11.
Figure 15:
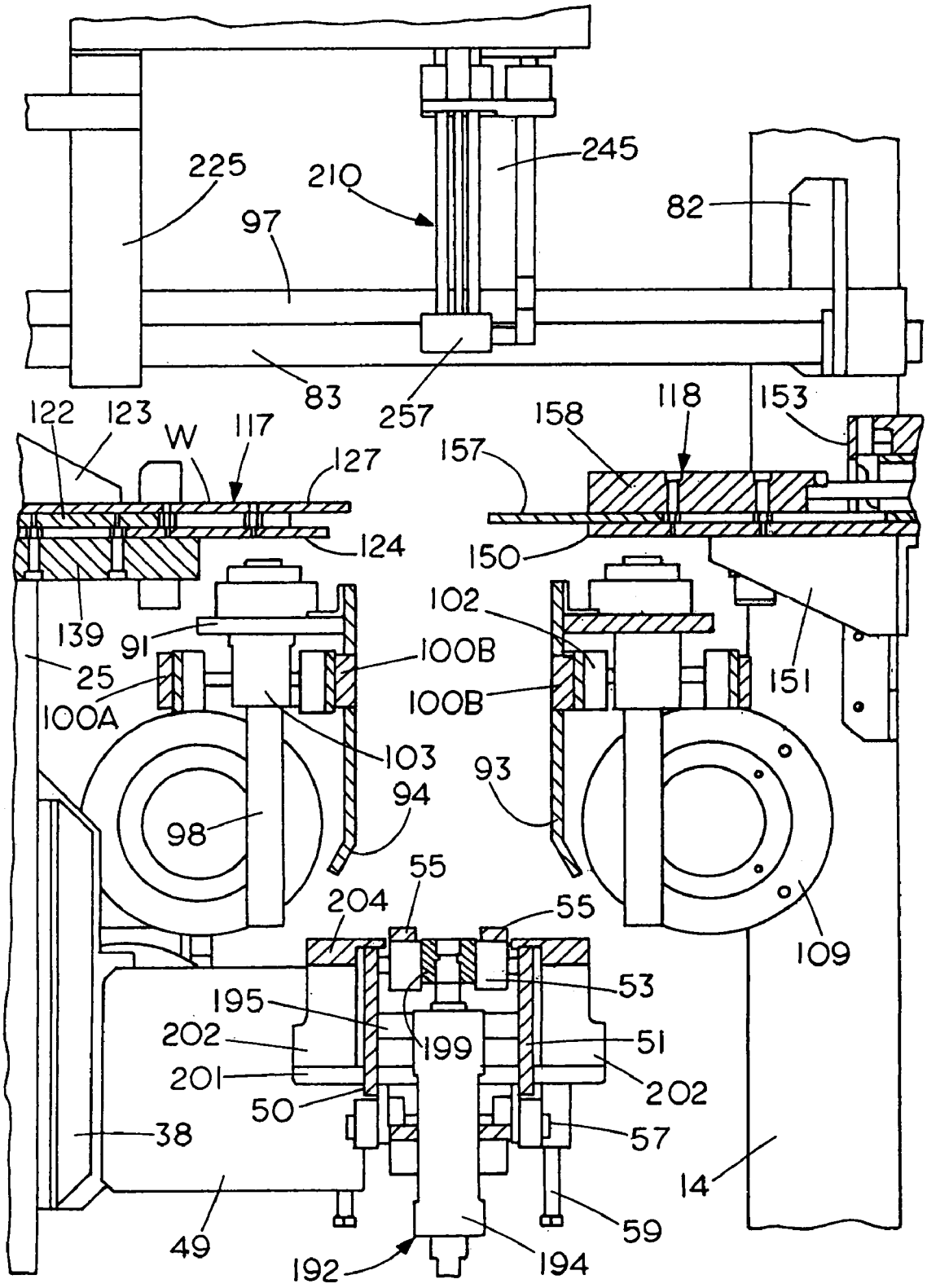
FIG. 15 is a fragmentary transverse cross sectional view that is generally taken along the line and in the direction of the arrows 15-15 of FIG. 1.
Figure 16:
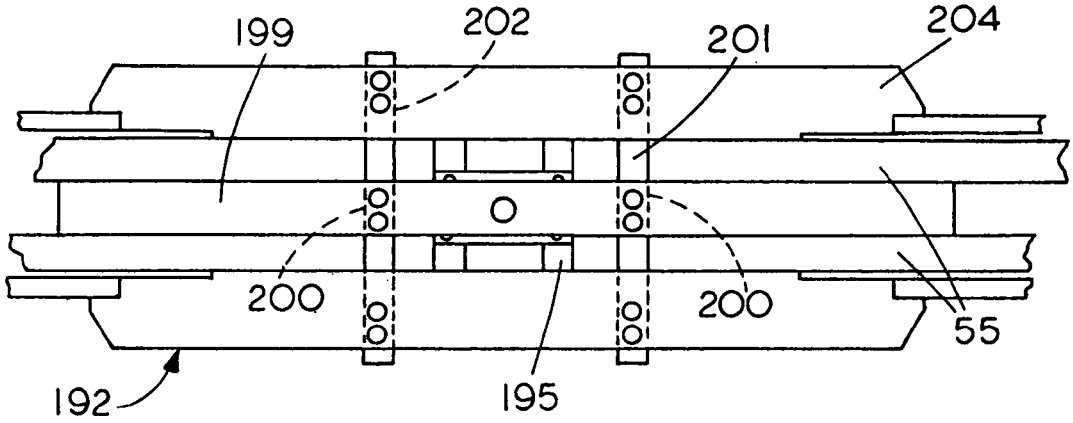
FIG. 16 is a plan view of the elevator subassembly that is generally taken along the line and in the direction of the arrows 16-16 of FIG. 17.
Figure 17:
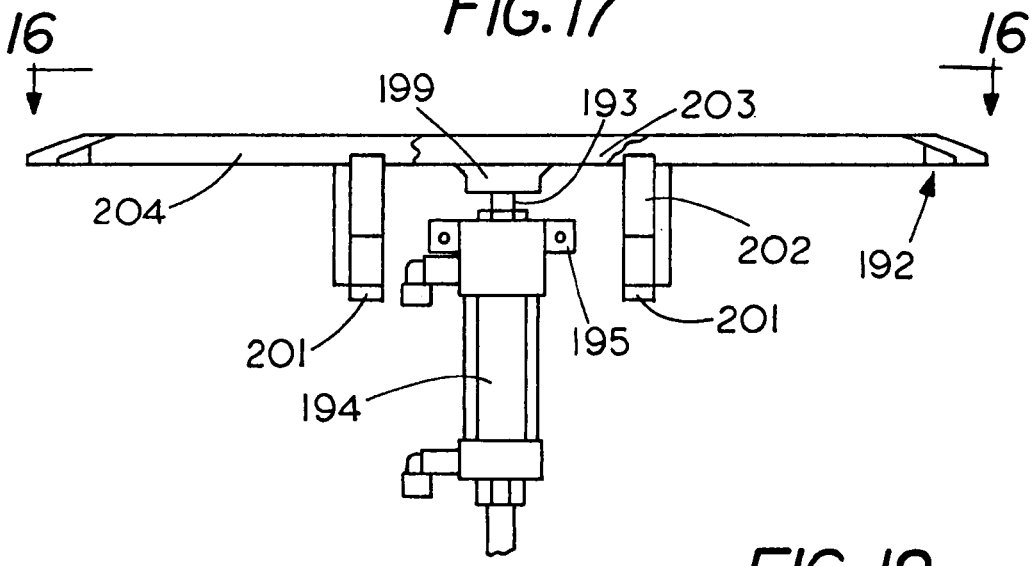
FIG. 17 is a side view of the elevator subassembly.

As shown in FIG. 14, the piston rods 175 are in their retracted position and the piston rods 159 in their extended positions. As the piston rods 159 are retracted, the center folder along with the link plate are moved relative to the wiper mount to be transversely more closely adjacent to the subassembly 117. When the piston rods 175 are extended, the flap tuckers are moved to have their flap tucker edges 155A located more closely adjacent to the subassembly 117 and in substantial longitudinal alignment with center folder edge 157A. The slot 154 is of a size and shape that when the piston rods 159 are in their extended position and piston rods 175 are in their retracted position such as shown in FIGS. 11, 14, the cylinder 158 is entirely to the left of the link plate while in their retracted position, the cylinder 158 in part extends to the right of the link plate and the center folder and flap tuckers 155 are transversely extend more closely adjacent to the subassembly 117. When the piston rods 159 are retracted both the center folder 157 and the flap tuckers 155 are moved more closely adjacent to the subassembly 117.

Figure 7:
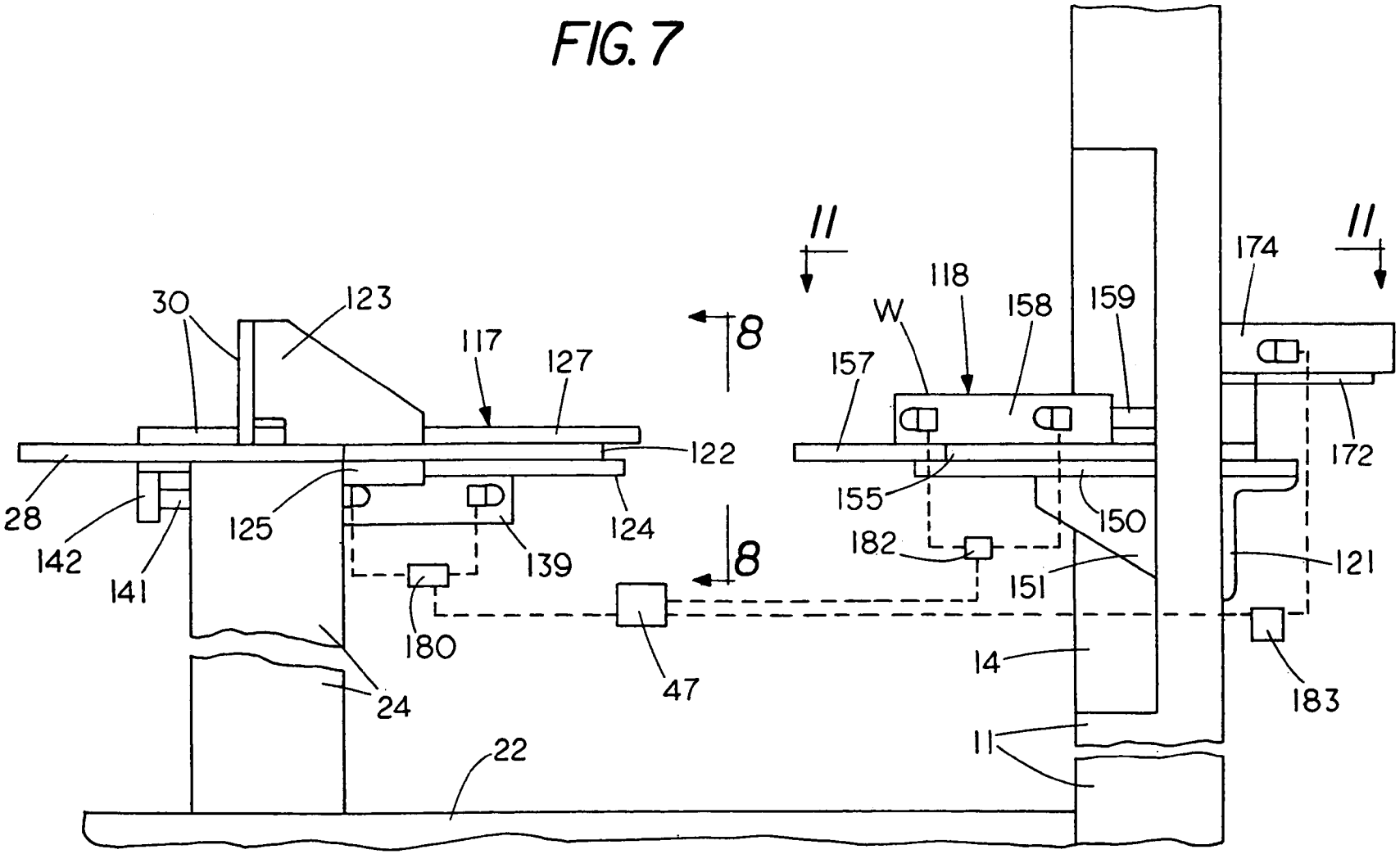
FIG. 7 is a fragmentary transverse sectional view of the bag top folder assembly.
Figure 8:
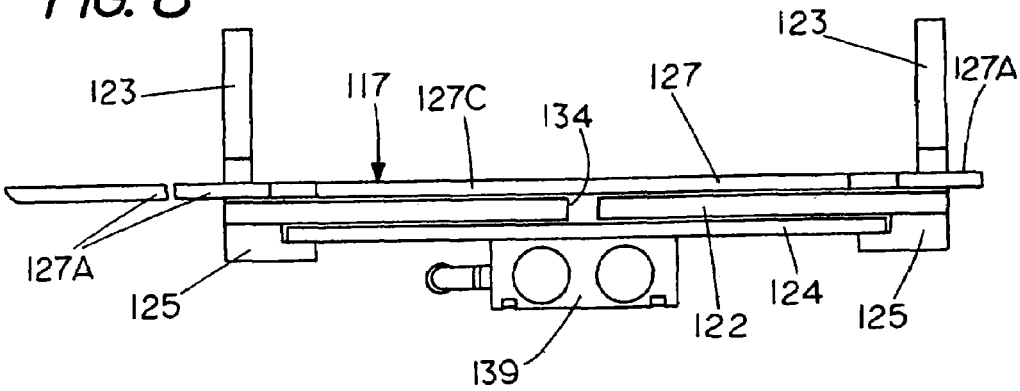
FIG. 8 is a side view of one of the folder subassemblies that is taken along the line and in the direction of the arrows 8-8 of FIG. 7 with portions of the wiper fingers being broken away.
Figure 9:
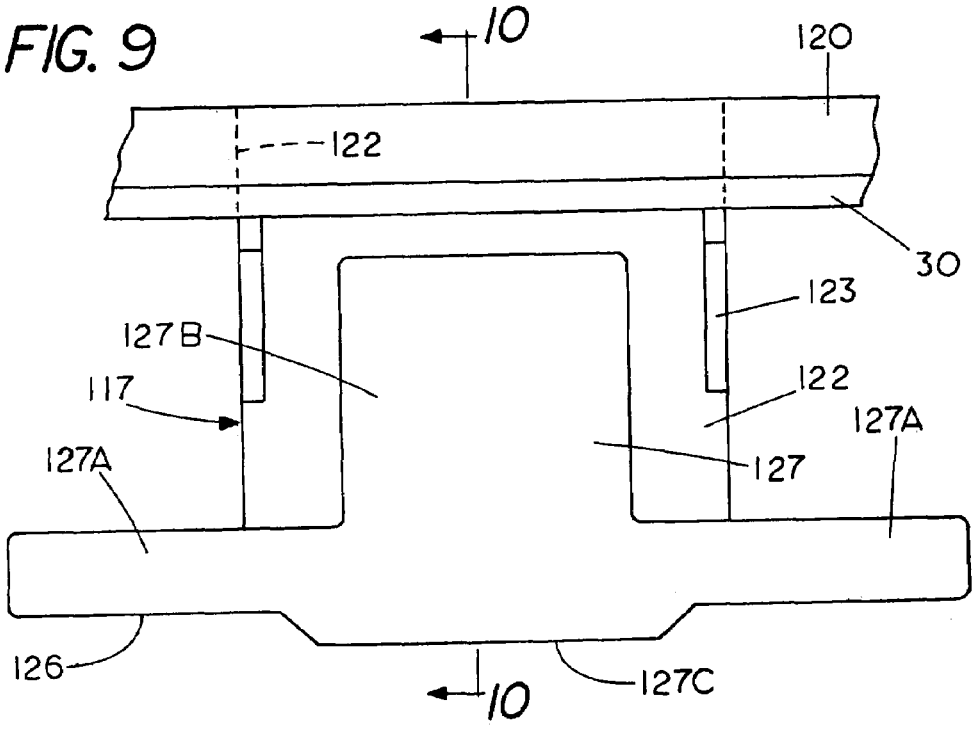
FIG. 9 is a plan view of the structure of FIG. 8.
Figure 10:
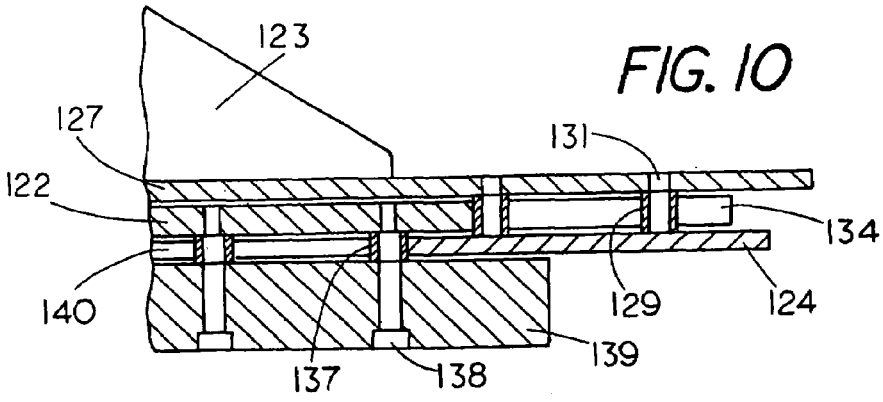
FIG. 10 is an enlarged transverse cross sectional view that is generally taken along the line and in the direction of the arrows 10-10 of FIG. 9.

Referring in particular to FIG. 7, operative valve mechanism 180 is connected to the ports of cylinder 139 for controlling the extension and retraction of the piston rods 141. Similarly, operative valve mechanism 182 is connected to the ports of cylinder 158 for controlling the extension and retraction of the piston rods 159 while operative valve mechanism 183 is connected to the ports of cylinder 174 to control the extension and retraction of the piston rods 175. Valve mechanisms 180, 182 and 183 are of a conventional construction, the operation of which is controlled by controls 47. Similarly the cylinders 139, 158 and 174 are of a conventional construction.

Referring to FIGS. 1 and 15-17, transversely aligned with the bag folder assembly W and vertically at a lower elevation is an elevator subassembly, generally 192, that is mounted to bottom conveyor side plates 50, 51. The elevator subassembly includes a piston cylinder combination 193, 194 with the cylinder being mounted between and to the side plates 50, 51 by a cylinder mount 195. The piston rod 193 mounts a longitudinally elongated elevator center plate 199 in transverse centered relationship to the upper runs of belts 55. The center plate dependingly mount center brackets 200 with the cylinder longitudinally centered therebetween, the center brackets each mounting a bar 201 extending transversely away therefrom in each direction. The transversely opposite end portions of each bar mounts an end bracket 202 to extend thereabove, the bars and end brackets extending transversely outward through slots 205 in the side plates 50, 51 to be vertically moveable a limited amount relative to the belts 55 (slots shown in FIG. 1). The end brackets on the one transverse ends of the bars mount a longitudinally elongated elevator end plate 204 as do the end brackets on the transverse opposite ends of the bars 201. The end plates are spaced from the center plate to have the upper runs of the belts 55 extend between the center plate and the respective end plate.

When the piston rod 193 is in a retracted position, the elevator plates 199, 204 are at least a slightly lower elevation than the top surfaces of the belts and when at its extended position, the plates are at a sufficiently higher elevation than the belts to lift a filled bag above the surfaces of the belt upper runs. In the piston rod elevated position and the piston rods 141, 159 in their retracted position, the plates 199, 204 will elevated the bag sufficiently that product in the bag may be compressed as a result of the guide plate 124 limiting the upward movement of the filled portion of the bag, this to compensate for different densities of the product in filled bags.

Referring to FIGS. 1, 15 and 19-21, to retain the bag top in a generally Z-shaped folded condition and fold the ears downwardly, there are provided convention right hand and left hand labeler assemblies, generally designated 210 and 211 respectively that are mounted to a labeler subframe, generally designated 212. The subframe includes longitudinal frame members 215 and transverse frame members 218 joined to one another to provide an open rectangular subframe. Vertical members 216 are joined to frame members 15 to extend thereabove for mounting the subframe. Transverse support members 214 are mounted to frame members 215 that in turn mount longitudinal rods 217.

Each of the labeler assemblies is mounted by a plate 220, and plate 223 and arm 227 with the plates in turn being dependingly mounted to the rods 217 by clamps 221 for adjustable longitudinal adjustment. A vertical support member 225 is dependingly secured to the plate 223 and has horizontal arms 226, 227, 233 and 240 mounted thereto. Since the right and left hand assemblies are conventional, for example ones sold by Accraply, Inc. of Minnetonka, Minn., many structural features for feeding web material with labels thereon from the supply reel 230 to the peeler arm 231 and winding the web with the labels removed will not be described but rather are indicated by the box 222 since such is known in the prior art. The structure indicated by the box is mounted to one or more of arms 226, 227, 233 and 240 and does not form part of this invention. Further, since the assemblies are the same other than one is a left hand subassembly and the other is a right hand subassembly, for the most part only the subassembly 211 will be described hereinafter.

Figure 19:
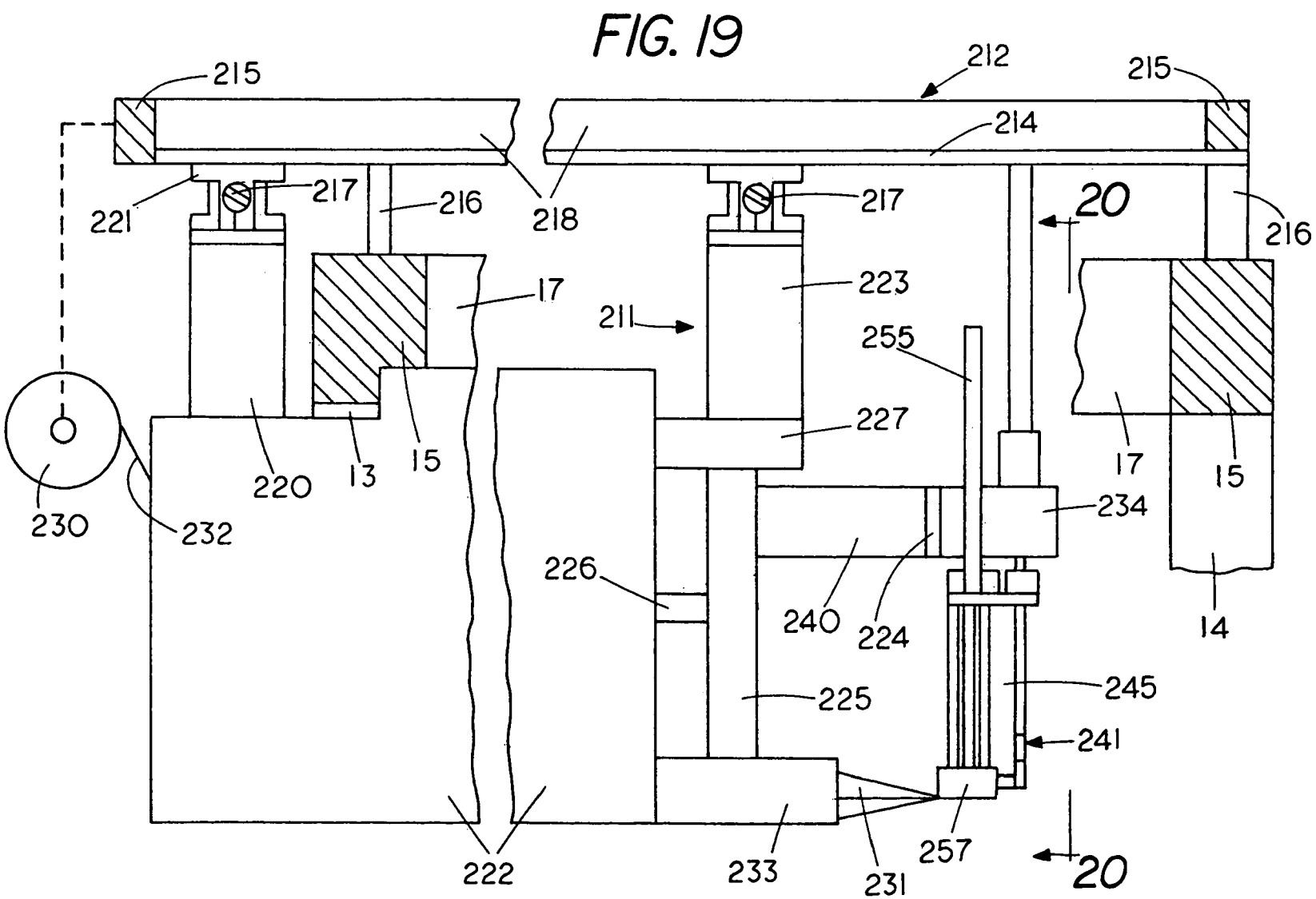
FIG. 19 is a transverse view of one of the labeler subassemblies that for the most part is diagrammatically shown.
Figure 20:
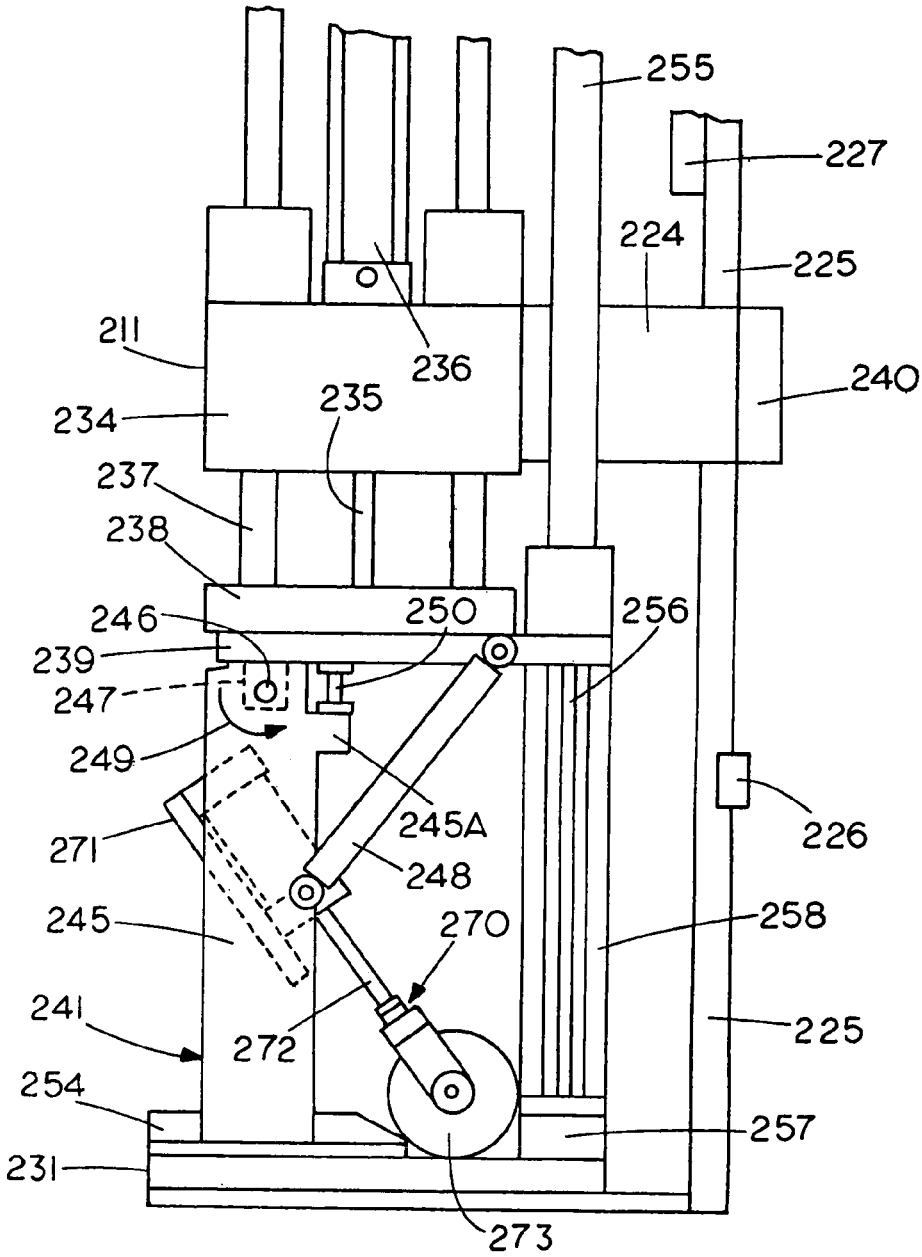
FIG. 20 is a fragmentary side view of part of the subassembly shown in FIG. 19 and is generally taken along the line and in the direction of the arrows 20-20 of FIG. 19.

Referring to FIGS. 19 and 20, the subassembly 211 includes arm 240 mounting a bar 224 which in turn mounts a main mounting block 234. Block 234 mounts a cylinder 236 with its piston rod 235 mounting the mount 238 of labeler applicator mechanism, generally designated 241, for vertical movement relative to block 234. Guide rods 237 are mounted to mount 238 to move therewith and are slidably extended through the main block 234. The applicator mechanism includes a mounting plate 239 mounted to mount 238 to move therewith. One end portion of a vertically elongated mounting bracket 245 is pivotally mounted on a pivot 246 which in turn is mounted by a block 247 to the underside of plate 239. A coil spring 248 has one end portion connected to the vertical mid-portion of the bracket 145 while the opposite end is connected to the mounting plate 239 to constantly urge the bracket to pivot in the direction of the arrow 249 about pivot 246. Such pivotal movement is limited to a vertical position by a stop 250 mounted to the plate 239 abutting against a tab 245A of the bracket. 245. The end of the bracket opposite the pivot (lower end) mounts an impresser pad 254 to which a vacuum is applied for vacuumly gripping one end portion of a label L as it is separated from the web.

A cylinder 255 is mounted to plate 239 to move vertically therewith, a rod 256 being extended into cylinder 255 to mount the impresser pad 257 to have its bottom surface at substantially the same elevation as that of the first impresser pad 254 when the piston rod 237 is in its retracted position of FIG. 20 but applying a downward force to the pad 257 while the cylinder 255 is moved downwardly relative to the rod 256 as a result of the downward movement of the plate 239. For example, a spring (not shown) and appropriate stops in the cylinder (not shown) permit the cylinder 255 moving relative to the rod 256 as described herein. Guide rods 258 are fixed to the pad 257 and are slidably extendable through the plate 239 as the plate 239 moves downwardly relative to the pad 257 and the plate 239 moves downwardly relative to the block 234. The impresser pad 257 vacuumly engages the end portion of a label opposite that gripped by the impresser pad 254. With reference thereto, the maximum longitudinal spacing of the pads 257 of the subassemblies 210, 211 is less than the longitudinal spacing of the end wall portions 185X, 186X of a filled bag B while the minimum longitudinal spacing of the pads 254 in their elevated position is greater than the corresponding spacing of said end wall portions.

A wiper mechanism, generally designated 270, includes a diagonally extending cylinder 271 fixedly mounted to the bracket 245 and a piston rod 272 that mounts a wiper roller 273 to extend between the pads 254 and 257 when the piston rods 235 and 272 are in their retracted positions. The piston rod 272 in being extended with the roller abutting against a label being applied to a folded bag top closure results in the bracket 245 being pivoted in a direction opposite arrow 249 against the action of the spring 248. When the piston rods 235, 272 are retracted, the pads are located to have a label peeled from the web to extend beneath the impresser pads 254, 257 to be vacuumingly gripped prior to being completely separated from the web 232.

In use, a bag is filled and the bag have top side and end wall portions that are above the product in the bag are in abutting relationship and may have a conventional reclosable bag top zipper type seal (not shown), or its adjacent terminal edge portions 181 in a sealed condition, or the terminal edge portions otherwise retained in a closed condition. Then with the bag top portions extending generally vertically above the product, a filled bag B is moved onto the bottom conveyor assembly 35. The level of product in a filled bag is indicated by dotted line 275 in FIG. 26 wherein bag top side wall portions K, N that that are joined to lower side wall portions 185X, 187X converge upwardly and than substantially vertically along the parts designated T to the terminal edge portions 181. For simplicity, the top end wall portions are not specifically shown.

Now, with the elevating plates in their lowered position and the inner runs of the side conveyor belts inner runs along the length of the belt guides 101 being transversely more closely adjacent to one another than the bag side guides 93, 94 as a result of the piston rods 112 being in their extended position, the inner runs abut against the filled portion of the bag, the filled bag is conveyed forwardly by the side and bottom conveyor assemblies. Before the filled bag is moved between the folder subassemblies, piston rods 141 retract to transversely move guide plate 124 and wiper 127 to extend more closely adjacent to the bag top portion T when it is moved longitudinally adjacent thereto but not interfere with the forward movement of the bag. When the bag is moved above the elevating plates 199, 204 with the bag top extending between the folder subassemblies and extending thereabove together with bag side wall 184 being adjacent the wiper and guide plate and bag side wall 187 being adjacent to the center folder 157, the bottom and side conveyors discontinue moving the bag forwardly, the bag being at the bag top folding station. Then the piston rods 159 are retracted to move the center folder 157 along with the link plate 153 and the lower flap tuckers 155 toward the wiper 127 and the guide plate. Also the piston rods 175 are extended to move the flap tuckers relative to the center folder to extend more remote from frame member 121 with edges 155A, 157A being substantially the same transverse spacing from the frame member 121. The wiper fingers 127A are of dimensions to extend longitudinally in overlapping relationship to the flap tuckers when the piston rods 141, 159 are in their retracted positions and piston rods 175 are in their extended position.

The vertical spacing of the guide plate 124 from the wiper 127 is sufficiently great to have the center folder and portion of the bag top portion extend vertically between the guide plate and center folder and vertically between the center folder and wiper. Further, the longitudinal dimension of the center folder edge 157A is about the same as the corresponding dimension of the filled bag while the longitudinal dimension of the guide plate and wiper edge portion 127C may be less. Thus, as the center folder moves transversely toward subassembly 117, it extends between the plates 124, 127 and abuts against bag top side wall 187 to force the part of the bag top portion that abuts against edge portion 157A to move toward the wiper mount 122. Accordingly, the part of the bag top portions between the center folder and guide plate includes the part 184B of side wall 184 that is joined to the generally vertically extending part 184X extends generally horizontally beneath the guide plate and then is reversely bent to extend above the guide plate along part 184C while part 187B that is joined to the generally vertical part 187X of the other side wall and joined to part 187F extend generally horizontally above bag part 184C and beneath the center folder and then is reversely bent along part 187C to extend above the center folder to the side wall terminal edge portion 181A. Joined by the reversely curved parts that are joined to parts 184C and 187F are parts 184F, 187C respectively to extend horizontally above the center folder and below the wiper 127 in a direction toward to side wall portion 187X and have the terminal edge portions 181A with part 184F above part 187C.

During the folding referred to in the preceding paragraph, the end wall portions extending above product in the bag are also folded. For example, referring in particular to FIG. 24 there is formed a generally triangular end wall part 186A having one edge integrally joined to the generally vertically extending end wall part 186X which abuts against the product, a second edge joined to a first edge of a generally right triangular part 186B and a third edge joined to a first edge of a generally right angle triangular part 186H. The second edge of the triangular part 186B is joined to the adjacent transverse edge of side wall part 184B while the second edge of triangular part 186H is joined to the side wall part 187B. The third edge of triangular part 186B is joined to the minor base edge of a generally trapezoidal part 186C which extends transversely relative thereto while the third edge of triangular part 186H is joined to a longitudinal minor base edge of a trapezoidal part 186D to extend transversely relative thereto. The opposite longitudinal major base edge of part 186C is joined to rectangular part 186F which has its opposite longitudinal edge providing part of the bag top terminal peripheral edge 181A while the opposite longitudinal edge of part 186D is joined to part 186E which has it opposite edge providing part of the peripheral terminal edge 181A. Part 186F along one transverse edge is joined to side wall part 184F while its opposite transverse edge is joined to part 186E. The opposite transverse edge of part 186E is joined to side wall part 187C. One transversely extending edge of part 186C is joined to a corresponding edge of part 186D. The transverse opposite edge of part 186C is joined to side wall part 184C. Part 186D has one transversely extending edge joined to side wall part 187F and its opposite edge joined to side wall part 186D. Parts 186C, 186F are reversely folded at their juncture as are parts 186C, 186B are correspondingly folded but open in the opposite transverse direction. Parts 186E, 186D are reversely folded at their juncture to open transversely in the opposite direction from the opening of parts 186C, 186B. Thus, the side wall parts 184B, 184C, 184F extend in a generally Z shaped relationship to one another as do parts 186B, 186C, 186F.

When the center folder and the flap tuckers 155 have transversely moved relative to the wiper and guide plate to fold the bag top parts 186A, 186B, 186C, 186D, 186E, 186F and 186H, an ear J is formed that extends horizontally longitudinally outwardly of the side wall portion 186X but in the opposite longitudinal direction from side wall portion 185X from which an ear H is formed by corresponding parts designated 185A, 185B, 185C, 185D, 185E, 185F and 185H respectively that extend longitudinally outwardly relative to side wall portion 185X and are joined to one another in the same manner as those with the prefix 186. During the formation of ear J, a flap tucker extends between parts 186E, 186D with part 186F extending between the part 186E and the adjacent finger 127A and the other flap tucker extends between parts 185E, 185D with part 185F extending between the part 185E and the adjacent finger 127A during the formation of the ear H.

The bag top wall portions in being folded results in forming the ears to extend horizontally longitudinally in overlapping relationship to the flap tuckers 155. After the completion of the folding of the bag top by members 124, 127, 155 and 157, the piston rods 175 are retracted to retract the flap tuckers from extending beneath the ears.

After the ears are folded over the flap tuckers and the side conveyor belt inner runs 100B are moved to their transverse spread apart position, the elevating cylinder 194 raises the elevating plates 199, 204 to lift the filled bag above the lower conveyor belts to have the folded top portion 184B abut against the guide plate 124 to compensate for different bulk densities of the product in filled bags. Prior to the impresser heads 257 of the subassemblies 210, 211 being lowered, the impresser heads 257, 254 have vacuumly gripped pressure sensitive labels L that have been peeled by the peeler arms 231 from the webs 230. Piston rods 235 are extended to lower mounts 238 which lowers the impresser pads 254, 257 of both of the subassemblies 210, 211. The pads with the labels are lowered such that the pads 257 press the adjacent end portions 188 of the labels against the longitudinal opposite ends portions of the side wall fold part 184F which through the underlying end portions of fold part 187C clamp the end portions of the labels end and fold parts 184F, 187C against the longitudinal end portions of the center folder 157. The longitudinal terminal edge portions 126 of the fingers 127A are sufficiently transversely offset in a direction toward frame member 30 from edge portion 127C so as not to interfere with the downward movement of the pads 257 or wiper rollers and the fingers do not extend beneath pads 254 or 257. With the longitudinal adjacent end portions 188 of the labels and folds parts 184F, 187C clamped against the center folder, the piston rods 235 continue to extend to further lower the mounts 239 without any significant lowering of impresser pads 257. As a result, the impresser pads 254 are further lowered together with the piston rods 272 being extended whereby the rollers 273 force the ears to be folded down along the adjacent end walls of the bag and wipe the labels off the impresser pads 254 to extend beneath the ears and adhere to the front and rear bag walls beneath the ears. Thus the labels are of dimensions to extend above product in the bag and downwardly along the ears and in adhered relationship to the front and rear end walls of the bag below the ears. The wiping of the labels against the ears and the end walls of the bag is facilitated by the brackets 245 pivoting against the action of springs 248 as the piston rods 235, 272 extended. Prior to the retraction of piston rod 235, the application of vacuum to the impresser pads is discontinued.

After the labels are applied to the filled bag, the piston rods 141, 159 are extended to transversely move the plates 124, 127 and 157 to their maximum spread apart datum position. Thereafter, the elevating plates are lowered so that the filled bag resides on the bottom conveyor assembly belts and the cylinders 103 are actuated to move the inner runs of the belts to extend transversely more closely adjacent one another than the side guides 93, 94 and to be in abutting relationship to the bag side walls. Further the vacuum is no longer being applied to the impresser pads and the piston rods 235, 272 are retracted so the impresser pads and wiper rollers are elevated and thereafter the conveyor belts are operated to conveyor the filled bag forwardly. Sensors (not shown) may be provided to sense whether or not the ears have been folded and labels applied and if not, the operation is automatically stopped.

What is claimed is:

1. Apparatus for folding bag top portions of a bag filled with product that includes transversely opposite first and second bag top side wall portions and longitudinal opposite front and rear end wall portions extending above product in the bag and having terminal edge portions, and lower front and rear end portions and side wall portions extending with product being therebetween, comprising a longitudinally elongated frame having a front end portion and a rear end wall portion, a bag top folder assembly mounted to the frame for folding the bag top portions to at least in part extend in overlapping relationship to the product in the bag, the bag folder assembly including first and second folder subassemblies mounted to the frame intermediate the frame front and rear portions for having the bag top portions conveyed therebetween and a longitudinally elongated bottom conveyor assembly and side conveyor assembly mounted to the frame for conveying a filled bag in a longitudinal forward direction to have its bag top portions extend between the subassemblies, the first subassembly including a guide plate and first means connected to the guide plate for transversely moving it between a retracted datum position and a transversely extended position engageable with the first side wall portion between the product in the bag and the terminal edge portions, and the second subassembly includes a folder plate and second means for moving the folder plate transversely between a retracted position out of engagement with the bag top portions when the bag top portions are conveyed to extend between said subassemblies and an extended position to engage the bag top second side wall portion for folding the bag top portions to at least in part extend in overlapping relationship to the guide plate when the guide plate is in its extended position, the first subassembly including third means movable between a retracted position and an extended position for engaging the first side wall portion for reversely folding the bag top portions to at least in part extend in overlapping relationship to the folder plate when the folder plate is moved to its extended position.

2. The apparatus of the claim 1 wherein the side conveyor assembly include longitudinally elongated bag guides extending above the bottom conveyor assembly for having the filled bag conveyed therebetween and driven endless belts having longitudinally elongated, transversely adjacent inner runs, each of the bag guides having a longitudinally elongated slot that extends longitudinally to have the guide plate and folder plate extend thereabove when the guide plate and folder plate are in their extended positions and fourth means for selectively moving the inner runs to extend through the slots for being transversely more closely adjacent one another than the bag guides and in gripping engagement with the filled bag while the bag is being conveyed forwardly and permitting the inner runs moving transversely away from one another and out of gripping engagement with the filled bag.

3. The apparatus of claim 1 wherein there is provided means on the frame for elevating the filled bag off the bottom conveyor assembly to abut against at least one of the guide plate and folder plate for compensating for products of different densities in filled bags when at least one of the guide plate and folder plate is in its extended positions and the inner runs are out of gripping engagement with the filled bag.

4. The apparatus of claim 1 wherein the second subassembly includes flap tuckers with the folder plate extending longitudinally therebetween and means for moving the flap tuckers to extend about substantially as closely adjacent to the first subassembly as the folder plate in its extended position and a retracted position more remote from the first subassembly when the folder plate is in its extended position, the folder plate is about the same longitudinal dimension as the corresponding dimension of the filled bag and when the guide plate, folder plate and the third means have folded the bag top portion, the folded bag top portion is folded to have ears extending longitudinally in overlapping relationship to the flap tuckers and there is labeler mechanism for dispensing pressure sensitive labels to extend over the ears and longitudinally more remotely than the ears and longitudinally more closely adjacent to one another than the folded ears and means for abutting against the labels adjacent the ears for folding the ears to extend downwardly along the front and rear walls and wiping the labels to adhere to the ears and the front and rear lower end wall portions after the flap tuckers have been moved to their retracted position relative to the folder plate.

5. The apparatus of claim 1 wherein the first means includes wiper mounting mechanism mounted to the frame for mounting the guide plate for transverse reciprocal movement between its retracted and extended position and the third means includes a wiper plate on the mounting mechanism for movement between a retracted and an extended position and extending in vertical spaced relationship to and above the guide plate to have the folder plate extend therebetween when the wiper plate, the guide plate and the folder plate are in their extended positions.

6. The apparatus of claim 5 wherein the wiper plate is connected to the guide plate to move therewith between its retracted and extended positions.

7. The apparatus of claim 5 wherein the folder plate is of a longitudinal dimension that is about the same as the longitudinal dimensions of the filled bag side wall portions, the third means is of a greater longitudinal dimension than the folder plate for in folding the bag top portions to extend in overlapping relationship to the folder plate provide bag top portion ears extending longitudinally outwardly of the folder plate and the second subassembly includes first and second lower flap tuckers mounted to have the folder plate extend longitudinally therebetween and fourth means mounted for movement with the folder plate when it is moved from its retracted position to its extended position for moving the flap tuckers to aid in forming being moved to extend under said ears and for retracting the flap tuckers prior to the folder plate being retracted and the wiper plate is of a longitudinal dimension to extend in overlapping relationship to the folder tuckers when the flap tuckers are in their extended position.

8. The apparatus of claim 7 wherein the fourth means includes fifth means for mounting the flap tuckers with the folder plate extending longitudinally therebetween and a piston cylinder combination mounted on the folder plate to move therewith and operable for moving the fifth means to move the flap tuckers between an extended condition relative to the folder plate and a retracted position independent of the movement of the folder plate.

9. The apparatus of claim 7 wherein a bag elevating device is mounted to frame for elevating a filled bag relative to the guide plate to compensate for difference in density of product in filled bags and means for elevating said device after the third means has reversely folded the bag top portion and a labeler subassembly is mounted to the frame that includes means for disposing pressure sensitive labels for being applied to bag top portions to extend across the ears and at least in part of the way across the folded bag top intermediate the ears and after the third means has folded the bag top portion and the flap tuckers have been retracted, fold the ears downwardly along the front and rear lower bag end wall portions together with wiping across the disposed labels to adhere to the ears and to the front and rear bag lower end wall portions and to the folded bag top side wall portions longitudinally intermediate the ears.

10. Apparatus for folding bag top portions of a bag filled with product that includes transversely opposite first and second bag top side wall portions and longitudinal opposite front and rear end wall portions extending above product in the bag and having terminal edges portions, and lower front and rear end wall portions and side wall portions extending with product being therebetween, comprising a longitudinally elongated frame having a front end portion and a rear end portion, a bag top folder assembly mounted to the frame for folding the bag top portion to at least in part extend in overlapping relationship to the product in the bag, the bag folder assembly including first and second folder subassemblies mounted to the frame for having the bag top portions conveyed therebetween and a longitudinally elongated bottom conveyor assembly and a side conveyor side assembly mounted to the frame for conveying filled bags in a longitudinal forward direction to have their bag top portions conveyed to extend between the subassemblies, the first subassembly including a guide plate mount mounted to the frame, a guide plate mounted to the guide plate mount for transverse movement between a datum retracted position and an extended position extending more closely adjacent to the second subassembly without interfering with forward movement of a filled bag while being abuttable against the bag top first side wall portion, operable first means mounted to one of the frame and the guide plate mount for moving the guide plate between its positions, a wiper mounted in vertical spaced relationship to the guide plate and connected thereto for transverse movement between a datum retracted position and an extended position more closely adjacent to the second subassembly without interfering with the forward movement of the filled bag by the conveyor assemblies and the second subassembly includes a center folder mount mounted to the frame, a center folder mounted to the center folder mount for transverse movement from a retracted datum position to an extended position extending between the wiper and guide plate in abutting relationship to the bag top second side wall portion when the wiper and guide plate are in their extended positions for reversely folding bag top portions to form a generally Z-shaped fold and operable means mounted to one of the frame and center folder mount for moving the center folder between its positions.

11. The apparatus of claim 10 wherein a filled bag in being conveyed to extend between the folder subassemblies has its top side wall portions at their juncture to the side wall lower portions extend transversely toward one another in overlapping vertical spaced relationship to product in the bag and then primarily upwardly, the operable means including means for moving the center folder relative to the guide plate to reverse fold the bag top first side wall portion to extend generally horizontally over the guide plate and reversely fold the bag top second side wall portion to extend generally horizontally below the wiper.

12. The apparatus of claim 11 wherein the second subassembly includes a pair of flap tuckers with the center folder being longitudinally therebetween, the flap tuckers and the center folder having longitudinal terminal edges for engaging the bag top second side wall portion and means for moving the flap tuckers between an extend position to have their longitudinal edges extend closely adjacent to being in longitudinal alignment with the center folder longitudinal edge when the center folder is in its extend position and a retracted position relative to the center folder, the center folder being of a longitudinal dimension that is about the same as that of the filled bag and the wiper is a longitudinal dimension that is greater than the center folder and sufficiently great to fold the bag top end wall portions over the flap tuckers to aid in forming first and second bag top ears extending longitudinally away from the end wall lower portions in opposite longitudinal directions.

13. The apparatus of claim 12 wherein labeler mechanism is mounted to the frame for applying a pressure sensitive label to the folded bag top portions after the ears have been formed and the center folder, the guide plate and wiper are in their extended positions and after the flap tuckers have been retracted, to fold at least one ear downwardly and apply the label to adhere to the last mentioned ear and the adjacent lower end wall portion.

14. The apparatus of claim 13 wherein the labeler mechanism includes a first labeler subassembly for applying a first label to the first ear to adhere it to the adjacent lower end wall portion and a second labeler subassembly for applying a second label to the second ear to adhere it to the adjacent lower end wall portion, each labeler subassembly including a first and a second vacuumized pad for vacuumly gripping a label and a wiper roller for applying the label to one of the first and second ears respectively and there is elevating mechanism for elevating the filled bag off the bottom conveyor assembly to abut against at least one of the guide plate and the center folder for compensating for products of different densities in filled bags when the guide plate and center folder are in their extended position and prior to the labels being applied to the ears.

15. Apparatus for folding bag top portions of a bag filled with product that includes transversely opposite first and second bag top side wall portions and longitudinal opposite front and rear end wall portions extending above product in the bag and having terminal edges portions, and lower front and rear end wall portions and side wall portions extending with product being therebetween, comprising a longitudinally elongated frame having a front end portion and a rear end portion, a bag top folder assembly mounted to the frame intermediate the frame front and rear end portions for folding bag top portions to at least in part extend in overlapping relationship to the product in the bag, the bag folder assembly including first and second folder subassemblies mounted to the frame for having the bag top portions conveyed therebetween, conveyor means for conveying the filled bag from the frame rear end portion to the frame front end portion and stopping the conveyance of the filled bag when the filled bag has moved to have its bag top portion extend between the folder subassemblies and above the folder subassemblies, the folder subassemblies including cooperating means for folding the bag top first side wall portion to extend generally horizontally to provide a longitudinally extending first part that is joined to first side wall lower portion, a longitudinally extending second part joined to the first part to extend in over lapping relationship to the first part, and a longitudinally extending third part joined to the second part to extend in overlapping relationship to the third part, and the bag top portion second side wall portion to extend generally horizontally to provide a longitudinally extending fourth part joined to the second side wall lower portion and extending in overlapping relationship to the second part and a longitudinally extending fifth part extending between the fourth part and the third part.

16. The apparatus of claim 15 wherein the cooperating means includes a second subassembly center folder that is transversely movable between a retracted position and an extended position for moving the bag top portion second side wall transversely toward the first subassembly for cooperating with the first subassembly to extend between the fourth and fifth parts and means for mounting the center folder to the frame and moving it between its positions.

17. The apparatus of claim 16 wherein the cooperating means includes a first subassembly guide plate, a wiper plate extending above the guide plate in vertical spaced relationship thereto and means for mounting the guide plate and wiper plate to the frame for movement between a retracted position relative to the second subassembly and an extended position to have the center folder extend therebetween when the center folder is in its extended position for having the guide plate extend between the first and second parts and wiper plate extend above the third part in engagement therewith.

18. The apparatus of claim 17 wherein the second subassembly includes flap tuckers with the center folder extending longitudinally therebetween for engaging the bag top end wall portions for forming ears extending longitudinally outwardly of the respective end wall lower portions from the first through fifth parts in longitudinal opposite direction and means for mounting the flap tuckers to the center folder for movement therewith and relative thereto between an extended position relative to the center folder for forming the ears as the first through fifth parts are being folded and a retracted position after the ears are formed.

19. The apparatus of claim 18 wherein labeler mechanism is mounted to the frame for applying pressure sensitive labels to the fifth part and to the ears and folding the ears downwardly for adhering the ears to the lower end wall portions while the center folder is in its extended position and the folder tuckers are in their retracted position relative to the center folder.

20. Apparatus for folding bag top portions of a bag that is filled with product has bag top terminal edges in a closed condition and includes transversely opposite first and second bag top side wall portions extending generally vertically above product in the bag with bag top terminal edges portions being above the product and lower side wall portions having product extending therebetween, comprising a longitudinally elongated frame having a front end portion and a rear end portion, conveyor means for conveying the filled bag from the frame rear end portion to the frame front portion and stopping the conveyance of the filled bag intermediate the frame portions for having the bag top portions folded and a bag top folder assembly mounted to the frame intermediate the frame front and rear end portions for folding bag top portions to at least in part extend in overlapping relationship to the product in the bag when the conveyance of the bag is stopped, the folder assembly including a guide plate transversely movable between a retracted position and an extended position for engaging the bag top first side wall portion, a wiper mounted to the guide plate for movement therewith and at least in part in vertical spaced relationship above the guide plate for having the bag top side wall portions extend between the guide plate and the wiper, the wiper in its extended position having a longitudinal terminal edge that includes longitudinally opposite end portions engagable with the bag top first side wall portion and a central portion extending more closely adjacent to the bag top first side wall than the longitudinal end portions when the conveyance of a filled bag is stopped, a center folder mounted for transverse movement between a retracted position permitting the bag top portion being movable between it and the guide plate and wiper plate and when the conveyance of the filled bag is stopped, an extended position abuttable against the bag top second side wall portion and extending between the guide plate and wiper for folding the bag top portions to in part extend between the guide plate and the center folder and reversely folded to in part extend between the center folder and the wiper and in part extending over the center folder to have longitudinal opposite bag top side wall parts including the bag top terminal edges extend over the center folder while being free of extension under the wiper and a labeler assembly mounted to the frame for applying labels to adhere to the said longitudinally opposite bag top side wall parts and to bag lower portions below folder bag top parts.

* * * * *